United States Patent [19]

Ishikawa et al.

[11] Patent Number: 4,962,014

[45] Date of Patent: Oct. 9, 1990

[54] PROCESS FOR PROCESSING SILVER HALIDE COLOR PHOTOGRAPHIC MATERIALS

[75] Inventors: Takatoshi Ishikawa; Junya Nakajima, both of Kanagawa, Japan

[73] Assignee: Fuji Photo Film Co., Ltd., Kanagawa, Japan

[21] Appl. No.: 300,685

[22] Filed: Jan. 19, 1989

Related U.S. Application Data

[63] Continuation of Ser. No. 927,615, Nov. 6, 1986, abandoned.

[30] Foreign Application Priority Data

Nov. 6, 1986 [JP] Japan ..... 60-247220

[51] Int. Cl.[5] ..... G03C 7/42

[52] U.S. Cl. ..... 430/393; 430/372; 430/386; 430/398; 430/460

[58] Field of Search ..... 430/393, 386, 387, 476, 430/558, 372, 400, 460, 963, 398

[56] References Cited

U.S. PATENT DOCUMENTS

| | | | |
|---|---|---|---|
| 3,061,432 | 10/1962 | Menzel et al. | 430/558 X |
| 3,317,322 | 5/1967 | Porter et al. | 430/567 |
| 3,701,783 | 10/1972 | Barr et al. | 548/221 X |
| 4,264,723 | 4/1981 | Ichijima et al. | 430/555 |
| 4,336,324 | 6/1982 | Koboshi et al. | 430/372 |
| 4,500,630 | 2/1985 | Sato et al. | 430/558 X |
| 4,621,046 | 11/1986 | Sato et al. | 548/210 X |
| 4,756,918 | 7/1988 | Ueda et al. | 430/393 |

FOREIGN PATENT DOCUMENTS

| | | |
|---|---|---|
| 0071402 | 9/1983 | European Pat. Off. . |
| 1247493 | 9/1971 | United Kingdom . |
| 1494777 | 12/1977 | United Kingdom . |

OTHER PUBLICATIONS

U.S. Ser. No. 07/068,503, "Method of Processing Silver Halide Color Photographic Material".

CP-20 Standard Processing Steps, p. 397, Shashin no Jiten, (Encyclopedia of Photograph), Japan, May 20, 1983.

Using Kodak Ektaprint 2 Chemicals, 3rd Edition, Eastman Kodak Company, 1979.

*Primary Examiner*—Paul R. Michl

*Assistant Examiner*—Hoa Van Le

*Attorney, Agent, or Firm*—Sughrue, Mion, Zinn, Macpeak & Seas

[57] ABSTRACT

A process for processing a silver halide color photographic material after imagewise exposing said silver halide color photographic material, comprising color developing, blixing, and then washing, wherein the processing time for said blixing is from about 30 seconds to about 70 seconds, the blixing liquid for said blixing contains from about 0.08 to about 0.30 mol/liter of sulfite ion, and the replenishing amount of washing water for said washing is from about 3 times to about 50 times the amount of processing liquid carried from the previous bath per unit area of said color photographic material.

18 Claims, No Drawings

PROCESS FOR PROCESSING SILVER HALIDE COLOR PHOTOGRAPHIC MATERIALS

This is a continuation, of application Ser. No. 06/927,615, filed 11/6/86 now abandoned.

FIELD OF THE INVENTION

This invention relates to a process for processing silver halide color photographic materials, and more particularly to a process for processing silver halide color photographic materials capable of shortening the processing time for the bleach-fix (blix) process and greatly reducing the amount of replenisher required for the water-wash step without reducing the stability or storage property of color images formed.

BACKGROUND OF THE INVENTION

Hitherto, many investigations have been made for the reduction of processing time for silver halide color photographic materials. In these investigations, in regard to shortening of the processing time of a blix process, the development of new blixing agents or bleaching agents have been the main purpose.

However, in these previous attempts, typically, the cost of compounds is high, or the effect of accelerating blix is insufficient, and fully satisfactory procedures and compounds have not yet been discovered. Thus, the actual practice has been to shorten the processing time by controlling the coated silver amount of the silver halide color photographic materials to be processed as well as the bleaching agent, fixing agent, pH and/or the concentrations of salts in the blix solution.

On the other hand, in the washing step of photographic processing, a processing process capable of greatly saving water has recently been proposed, mainly for saving water resources and reducing conduits for washing at installations of processors. These techniques are disclosed, for example, in Japanese Patent Application (OPI) Nos. 70549/81, 132146/82, 8543/82, 18631/83, 184343/84, 184345/84, 14834/83 (the term "OPI" as used herein refers to a "published unexamined Japanese patent application"), etc.

However, the attempt of performing the combination of shortening of the processing time of a blix process and the water saving process encounters a new problem, in that the storage property of color images of color photographic materials after processing is reduced. In other words, when the blixing time is shortened and then a washing step with water saving is employed, yellow stains and/or magenta stains are more liable to occur on the color photographic materials thus processed, e.g., prints with the passage of time. In particular, it has been found that when 2-equivalent magenta couplers showing high coloring property are used, the aforesaid occurrence of magenta stain becomes more severe.

It is presumed that the magenta stain occurs because washing of color developer components carried from the previous bath is insufficient as a result of shortening of the blixing time and also the color developer components are not sufficiently washed away as a result of the great saving of wash replenisher in the wasing step.

SUMMARY OF THE INVENTION

The object of this invention is, therefore, to provide a process for processing silver halide color photographic materials, which gives color images having good storage properties even in the processing step of greatly shortening the blixing time and also greatly saving the amount of replenisher for washing step.

As a result of extensive investigations, it has now been discovered that the above and other objects of the present invention can be attained by a process for processing a silver halide color photographic material after imagewise exposing the silver halide color photographic material, comprising color developing, blixing and then washing, wherein the processing time for the blix step is from about 30 seconds to about 70 seconds, the blix liquid which is used for the blix step contains from about 0.08 to about 0.30 mol/liter of sulfite ion, and the replenishing amount of wash water for the washing step is from about 3 times to about 50 times the amount of processing liquid carried from the previous bath per unit area of the color photographic material.

DETAILED DESCRIPTION OF THE INVENTION

The invention is explained below in more detail.

The processing time for the blix step in the present invention is from about 30 seconds to about 70 seconds, which is greatly shortened as compared with the processing time (about 1 minute 30 seconds) for a conventional blix step. The processing time for the blix step (hereinafter referred to simply as "blixing time") is the time required for a light-sensitive material from being brought into contact with a blix liquid to being brought into contact with wash water of the subsequent wash bath. That is, the blixing time is the sum of the time that a light-sensitive material is immersed in a blix bath and the time required for moving the light-sensitive material from the blix bath to the subsequent wash bath, i.e., the time that the light-sensitive material is in the air between both of the baths. The preferred blixing time in this invention is from 40 seconds to 60 seconds.

The blix liquid for use in the present invention contains a sulfurous acid ion releasing compound such as a sulfite (e.g., sodium sulfite, potassium sulfite, ammonium sulfite, etc.), a hydrogensulfite (e.g., ammonium hydrogensulfite, sodium hydrogensulfite, potassium hydrogensulfite, etc.), a metahydrogensulfite (e.g., potassium metahydrogensulfite, sodium metahydrogensulfite, ammonium metahydrogensulfite, etc.), etc., as preservatives. It is necessary that such a compound is contained in the blix liquid in an amount of from about 0.08 to 0.30 mol/liter, and preferably from about 0.10 to 0.20 mol/liter of sulfite ion. If the concentration of the sulfite ion is less than 0.08 mol/liter, the above-described stain preventing faculty is insufficient and if the concentration is about 0.30 mol/liter, the removal of silver becomes insufficient.

Other preservatives which can be used in this invention include hydroxylamine, hydrazine, a hydrogensulfite addition product of an aldehyde compound (e.g., sodium acetaldehyde hydrogensulfite), etc.

Bleaching agents which can be used for the blix liquid in the present invention include organic complex salts of iron(III) (e.g., iron(III) complex salts of aminopolycarboxylic acids such as ethylenediaminetetraacetic acid, diethylenetriaminepentaacetic acid, etc., or organic phosphonic acids such as aminopolyphosphonic acid, phosphonocarboxylic acid, etc.); organic acids such as citric acid, tartaric acid, malic acid, etc.; persulfates; hydrogen peroxide, etc. In these substances, organic complex salts of iron(III) are preferred from the viewpoints of quick processing and the prevention of environmental pollution.

Examples of the useful aminopolycarboxylic acid, aminopolyphosphonic acid, and organic phosphonic acid for forming the organic complex salts of iron(III) include:

Ethylenediaminetetraacetic acid,
Diethylenetriaminepentaacetic acid,
Ethylenediamine-N-(β-oxyethyl)-N,N',N'-triacetic acid,
1,2-Diaminopropanetetraacetic acid,
Triethylenetetraminehexaacetic acid,
Propylenediaminetetraacetic acid,
Nitrilotriacetic acid,
Nitrilotripropionic acid,
Cyclohexanediaminetetraacetic acid,
1,3-Diamino-2-propanoltetraacetic acid,
Methyliminodiacetic acid,
Iminodiacetic acid,
Hydroxyliminodiacetic acid,
Dihydroxyethylglycine ethyl ether diaminetetraacetic acid,
Glycol ether diaminetetraacetic acid,
Ethylenediaminetetrapropionic acid,
Ethylenediaminedipropionic acid,
Phenylenediaminetetraacetic acid,
2-Phosphonobutane-1,2,4-triacetic acid,
1,3-Diaminopropanol-N,N,N',N'-tetramethylenephosphonic acid,
Ethylenediamine-N,N,N',N'-tetramethylenephosphonic acid,
1,3-Propylenediamine-N,N,N',N'-tetramethylenephosphonic acid,
1-Hydroxyethylidene-1,1'-diphosphonic acid, etc.

The above-described compounds may be in the forms of sodium salts, potassium salts, lithium salts, or ammonium salts. In these compounds, the iron(III) complex salts of ethylenediaminetetraacetic acid, diethylenetriaminepentaacetic acid, cyclohexanediaminetetraacetic acid, 1,2-diaminopropanetetraacetic acid, and methyliminodiacetic acid are preferred because of their high blixing power.

The amount of the bleaching agent per liter of the blix liquid is preferably from 0.15 mol to 0.5 mol, and more preferably from 0.2 to 0.4 mol, for the purpose of increasing the processing speed.

As fixing agents which can be used for the blix liquid in the present invention, known fixing agents, e.g., thiosulfates such as sodium thiosulfate, ammonium thiosulfate, etc.; thiocyanates such as sodium thiocyanate, ammonium thiocyanate, etc.; thioether compounds such as ethylenebisthioglycolic acid, 3,6-dithia-1,8-octanediol, etc.; and water-soluble silver halide solvents such as thioureas, etc., can be used singly or as a mixture thereof.

Also, a special blix liquid comprising a combination of the fixing agents described in Japanese Patent Application (OPI) No. 155354/80 and a large amount of a halide such as potassium iodide can be used.

In the present invention, the use of thiosulfates, particularly ammonium thiosulfate is preferred.

The amount of the fixing agent per liter of the blix liquid is generally from 0.3 to 2 mols, and preferably from 0.5 to 1.0 mol.

The pH region of the blix liquid for use in the present invention is preferably from 4 to 8, more preferably from 5 to 7.5. If the pH is lower than 4, the deterioration of the blix liquid and the conversion of cyan dyes into leuco compounds are accelerated, although the silver removal may be improved. If the pH is higher than 8, the silver removal is delayed and stain is liable to form.

For adjusting the pH of the blix liquid, if necessary, hydrochloric acid, sulfuric acid, nitric acid, acetic acid, hydrogencarbonates, ammonia, potassium hydroxide, sodium hydroxide, sodium carbonate, potassium carbonate, etc., can be used.

Also, the blix liquid for use in the present invention may further contain an optical whitening agent, a defoaming agent, a surface active agent, polyvinylpyrrolidone, an organic solvent such as methanol, etc.

Furthermore, the blix liquid for use in the present invention can, if necessary, contain a bleaching accelerator. Specific examples of useful bleaching accelerators include compounds having a mercapto group or a disulfide group described in U.S. Pat. No. 3,893,858, West German Pat. Nos. 1,290,812, 2,059,988, Japanese Patent Application (OPI) Nos. 32736/78, 57831/78, 37418/78, 65723/78, 72623/78, 95630/78, 95631/78, 104232/78, 124424/78, 141623/78, 28426/78, *Research Disclosure*, No. 17129 (July, 1978), etc.; thiazolidine derivatives as described in Japanese Patent Application (OPI) No. 140129/75; thiourea derivatives described in Japanese Patent Publication No. 8506/70, Japanese Patent Application (OPI) Nos. 20832/77, 32735/78, U.S. Pat. No. 3,706,561, etc.; iodides described in West German Pat. No. 1,127,715, Japanese Patent Application (OPI) No. 16235/83, etc.; polyethylene oxides described in West German Pat. Nos. 966,410, 2,748,430, etc.; polyamine compounds described in Japanese Patent Publication No. 8836/70, etc.; the compounds described in Japanese Patent Application (OPI) Nos. 42434/74, 59644/74, 94927/78, 35727/79, 26506/80, and 163940/83; and iodine ions and bromine ions. In these compounds, the compounds having a mercapto group or a disulfide group are preferred from the viewpoint of high acceleration effect, and the compounds described in U.S. Pat. No. 3,893,858, West German Pat. No. 1,290,812, and Japanese Patent Application (OPI) No. 95630/78 are particularly preferred.

Still further, the blix liquid for use in the present invention may contain a rehalogenating agent such as bromides (e.g., potassium bromide, sodium bromide, ammonium bromide, etc.), chlorides (e.g., potassium chloride, sodium chloride, ammonium chloride, etc.), or iodides (e.g., ammonium iodide, etc.). Also, the blix liquid may further contain, if necessary, inorganic acids or organic acids having a pH buffer faculty and the alkali metal or ammonium salts thereof, such as boric acid, borax, sodium metaborate, acetic acid, sodium acetate, sodium bromate, potassium borate, phosphorous acid, phosphoric acid, sodium phosphate, citric acid, sodium citrate, tartaric acid, etc., and a corrosion preventing agent, such as ammonium nitrate, guanidine, etc.

The silver halide color photographic materials of the present invention are washed after blix processing. It is a feature of the present invention that in the washing process in the present invention, the replenishing amount of water required is greatly reduced. That is, the replenishing amount of washing water in the present invention is from about 3 to about 50 times the amount of the liquid carried from the previous bath per unit area of the light-sensitive material. In other words, the replenishing amount of wash water required in accordance with the present invention can be greatly reduced, to an amount of from about 1/70 to ¼ of the replenishing amount of wash water (about 200 times the amount of the liquid carried from the previous bath per unit area of light-sensitive material) in ordinary washing process.

The optimum water replenishment amount utilized in the practice of the present invention depends upon the amount of liquid carried by light-sensitive materials from the previous bath and the washing process system (e.g., the number of baths in multistage countercurrent washing process), and, hence, it is difficult to specifically define the amount. However, in the case, for example, of three bath countercurrent washing process, it is preferred that the amount of replenishing wash water is from about 5 times to about 15 times the amount of the processing liquid carried from the previous bath per unit area of light-sensitive material.

The washing process in the present invention includes a process of performing so-called "stabilization process" without employing a substantial washing step in place of ordinary "washing process". Thus, "washing process" or "water washing process" in the present invention is used in a broad sense as described above.

The washing time in the present invention is typically from 30 seconds to 5 minutes, and preferably from 40 seconds to 4 minutes. The washing time in the present invention means a time required for a light-sensitive material to proceed from being brought into contact with wash water to reaching a drying zone, which is a final step. Also, when the washing step is a multistage countercurrent washing step, the washing time means the whole washing time required for a light-sensitive material from being brought into contact with wash water in the first wash bath to reaching the drying zone. When the so-called "stabilization process" is employed in place of ordinary washing process, the abovedescribed definition for washing time is applied.

The washing temperature in the present invention is typically from 15° C. to 45° C., and preferably from 20° C. to 35° C.

For the washing step, various kinds of compounds may be used for the prevention of occurrence of precipitation or the stabilization of washing water. For example, various antibacterial and antifungal agents described, for example, in *Journal of Antibacterial and Antifungal Agents,* Vol. 11, No. 5, pp. 207 to 223 (1983) and Hiroshi Horiguchi, *Bokin Bobai no Kagaku (Antibacterial and Antifunqal Chemistry)*, published by Sankyo Shuppan Co., Ltd. on Jan. 10, 1982, for preventing the generation of various bacteria, algae, and fungi; metal salts such as magnesium salts, aluminum salts, etc.; alkali metal salts; ammonium salts; or surface active agents for reducing drying load or preventing uneven drying may be, according to requirement, added to wash water. Also, the compounds described in West, *Photograohic Science and Engineering,* Vol. 6, pp. 344 to 359 (1965) may be added to wash water. The addition of a chelating agent or an antibacterial or antifungal agent is particularly effective.

The employment of a multistage countercurrent washing step (e.g., with 2 to 9 baths) as the washing step is advantageous for saving the amount of replenishing wash water required. Furthermore, the multistage countercurrent stabilizaticn processing step (so-called stabilization process) described in Japanese Patent Application (OPI) No. 8543/82 may be employed in place of an ordinary washing step. The stabilization bath(s) contains various kinds of compounds for the purpose of stabilizing color images formed. For example, there are various buffers (e.g., a combination of borates, metaborates, borax, phosphates, carbonates, potassium hydroxide, sodium hydroxide, aqueous ammonia, monocarboxylic acids, dicarboxylic acids, polycarboxylic acids, etc.) and aldehydes such as formalin, etc., for adjusting the pH of films or layers. Still further, chelating agents (e.g., inorganic phosphoric acids, aminopolycarboxylic acids, organic phosphonic acids, aminopolyphosphonic acids, phosphonocarboxylic acids, etc.), sterilizers (e.g., thiazoles, isothiazoles, halogenated phenols, sulfanylamides, benzotriazoles, etc.), surface active agents, optical whitening agents, hardening agents, etc., may be used. They can be used solely or as a combination of two or more same kind of or different kinds of compounds.

Also, various ammonium salts such as ammonium chloride, ammonium nitrate, ammonium sulfate, ammonium phosphate, ammonium sulfite, ammonium thiosulfate, etc., may be added to the stabilization bath(s) as a film pH adjusting agent for the processor.

The color development step which can be used in the present invention is explained below.

The processing time for the color developmenr step for use in this invention is generally from about 40 seconds to about 10 minutes, and preferably from about 50 seconds to about 4 minutes. The developing time in the present invention is preferably as short as practicably possible for the purpose of shortening the total processing time for all of the processing steps.

The color developer which is used for the color development processing in the present invention is an aqueous alkaline solution, preferably containing an aromatic primary amine developing agent as the main component. As such color developing agent, p-phenylenediamine series compounds are preferably used. Specific examples of the p-phenylenediamine series compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, etc., and sulfates, hydrochlorides, phosphates, p-toluenesulfonates, tetraphenylborates, p-(t-octyl)benzenesulfonates, etc., of the above-described compounds.

Also, for shortening the development time, the concentration of the developing agent in the color developer and the pH of the color developer are very important factors. In the present invention, the concentration of the developing agent is generally from about 1.0 g to about 15 g, and preferably from about 3.0 g to about 8.0 g, per liter of the color developer. The pH of the color developer is generally higher than 9, and preferably from about 9.5 to about 12.0.

The processing temperature of the color developer in the present invention is generally from 30° C. to 50° C., and preferably from 31° C. to 45° C.

Also in the present invention, various development accelerators may be used, if desired.

As the development accelerator, benzyl alcohol is effectively used, but other compounds, for example, the various pyrimidium compounds described in U.S. Pat. No. 2,648,604, Japanese Patent Publication No. 9503/69, U.S. Pat. No. 3,171,247, etc., other cationic compounds, cationic dyes such as phenosafranine, etc., neutral salts such as thallium nitrate, potassium nitrate, etc., the polyethylene glycol and the derivatives thereof described in Japanese Patent Publication No. 9304/69, U.S. Pat. Nos. 2,533,990, 2,531,832, 2,950,970, 2,577,127, etc., nonionic compounds such as polythioethers, etc., the thioether compounds described in U.S. Pat. No. 3,201,242, etc., may be used.

For the development step in the present invention, various antifoggants may be used for preventing the formation of development fog. As the antifoggants in the development step, alkali metal halides such as potassium bromide, sodium bromide, potassium iodide, etc., and organic antifoggants are preferable. Useful organic antifoggants include, for example, nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylmethylbenzimidazole, hydroxyazaindolizine, etc., mercapto-substituted heterocyclic compounds such as 1-phenyl-5-mercaptotetrazole, 2-mercaptobenzimidazole, 2-mercaptobenzothiazole, etc., and mercapto-substituted aromatic compounds such as thiosalicylic acid, etc. In the compounds described above, the halides as described above are particularly preferred. In addition, the antifoggant also includes an antifoggant which is dissolved from color photographic materials during processing and accumulates in the color developer.

Furthermore, the color developers for use in the present invention may contain a pH buffer such as carbonates, borates, or phosphates of an alkali metal; preservatives such as hydroxylamine, triethanolamine, the compounds described in West German Patent Application (OLS) No. 2,622,950, sulfites, hydrogensulfites, etc.; organic solvents such as diethylene glycol, etc.; dyeforming couplers; competing couplers; nucleating agents such as sodium boron hydride, etc.; auxiliary developing agents such as 1-phenyl-3-pyrazolidone, etc.; tackifiers; and chelating agents such as aminopolycarboxylic acids (e.g., ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, and the compounds described in Japanese Patent Application (OPI) No. 195845/83), aminophosphonic acids (1-hydroxyethylidene-1,1'-diphosphonic acid, the organic phosphonic acids described in *Research Disclosure,* No. 18170 (May, 1979), aminotris(methylenephosphonic acid), ethylenediamine-N,N,N',N'-tetramethylenephosphonic acid, etc.), and the phosphonocarboxylic acids described in Japanese Patent Application (OPI) Nos. 102726/77, 42730/78, 121127/79, 4024/80, 4025/80, 126241/80, 65955/80, 65956/80 and *Research Disclosure,* No. 18170 (May, 1979).

Also, the color development bath can be divided into two or more baths, if desired, whereby a color developer replenisher is supplied to the first bath or the final bath to shorten the developing time or reduce the amount of the replenisher.

The silver halide color photographic materials which are processed by the process of the presenr invention may contain therein various kinds of 1-phenyl-3-pyrazolidones for accelerating the color development. Specific examples of these 1-phenyl-3-pyrazolidones are described in Japanese Patent Application (OPI) Nos. 64339/81, 144547/82, 211147/82, 50532/83, 50536/83, 50533/83, 50534/83, 50535/83, 115438/83, etc.

Also, in the case of performing continuous processing, a constant finish is obtained by preventing the deviation of liquid compositions by using replenisher for each processing liquid. The amount of each replenisher may be reduced to a half or less of a standard amount of the replenisher of conventional processes for the reduction of cost, etc.

Each processing bath may, if desired, be equipped with a heater, a temperature sensor, a liquid level sensor, a circulation pump, a filter, a floating lid, a squeezer, a nitrogen stirrer, an air stirrer, etc.

Silver halide color photographic materials to which the process of the present invention is applied are explained below in more detail.

For the photographic emulsion layers of the color photographic materials for use in the present invention, silver chloride, silver chlorobromide, silver bromide, silver iodochlorobromide, or silver iodobromide may be used as the silver halide, but for shortening the blixing time, silver chloride, silver chlorobromide, or silver bromide is preferred, and in the case of using silver iodochlorobromide or silver iodobromide, it is preferred that the content of iodide is less than 1 mol %. Also, for the coated amount of silver (silver coverage) of the silver halide emulsion(s) to have an influence on, in particular, shortening of the blixing time in accordance with the present invention, the coated amount of silver is preferably not more than 2.0 g, and more preferably 1.0 g or less, per square meter of the color photographic material.

The silver halide photographic emulsions of the color photographic materials for use in the present invention may contain dye-forming couplers, that is, compounds capable of coloring by oxidative coupling with an aromatic primary amine developing agent (e.g., phenylenediamine derivatives and aminophenol derivatives) in color development. For example, magenta couplers include 5-pyrazolone couplers, pyrazolobenzimidazole couplers, cyanoacetylcumarone couplers, open chain acylacetcnitrile couplers, etc.; yellow couplers include acylacetamide couplers (e.g., benzoylacetanilides, pivaloylacetanilides, etc.), etc.; and cyan couplers include naphthol couplers and phenol couplers.

It is preferred that these couplers are non-diffusible couplers having a hydrophobic group referred to as ballast group in the coupler molecule or are polymerized couplers. The couplers may be 4-equivalent or 2-equivalent with respect to silver ions. Furthermore, the couplers may be colored couplers having a color correction effect or so-called DIR couplers or DAR couplers, i.e., couplers releasing a development inhibitor or development accelerator with the development.

Also, in place of DIR couplers, a non-coloring DIR coupling compound which gives a colorless product by the coupling reaction and releases a development inhibitor may be used.

Furthermore, the light-sensitive material may contain compounds releasing a development inhibitor with the color development in place of the above-described DIR couplers.

The above-described couplers, etc., may exist in one emulsion layer as a combination of two or more, and the same coupler or compound may exist in two or more emulsion layers in order to satisfy the characteristics required for a particular light-sensitive material.

The process of the present invention is particularly preferably applied to silver halide color photographic materials containing a magenta coupler represented by at least one of formulae (I) and (II), i.e.,

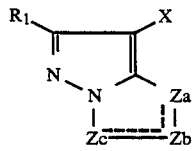

(I)

wherein $R_1$ represents a hydrogen atom or a monovalent organic substituent; X represents a hydrogen atom or a group capable of releasing upon occurrence of a coupling reaction with the oxidation product of an aromatic primary amine developing agent; and Za, Zb and Zc each represents a methine group, a substituted methine group, =N— or —NH—; at least one of said Za, Zb and Zc represents =N— or —NH—; one of the Za—Zb bond and the Zb—Zc bond is a double bond and the other is a single bond; and when the Zb—Zc bond is a carbon-carbon double bond, it may be a part of an aromatic ring; or said magenta coupler represented by formula (I) forms a dimer or oligomer at said $R_1$ or X; or when said Za, Zb or Zc is a substitured methine group, said magenta coupler forms a dimer or oligomer at said substituted methine group; and

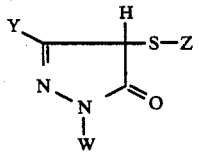

(II)

wherein W represents an aryl group; Z represents an alkyl group, an aryl group or a heterocyclic group; and Y represents an acylamino group, a ureido group or an anilino group.

The magenta couplers represented by formula (I) above are explained in more detail below.

The dimer or oligomer in formula (I) means the coupler having at least 2 moieties represented by formula (I) in 1 molecule and includes a bis compound, an oligomer, and a polymeric coupler. The polymeric coupler may be a homopolymer composed of 2 or more monomers (preferably a monomer having a vinyl group, hereinafter referred to as a vinyl monomer) having the moiety represented by formula (I) or a copolymer of the above-described monomer and a non-coloring ethylenical monomer which does not cause coupling with the oxidation product of an aromatic primary amine developing agent.

Preferred examples of the magenta couplers represented by formula (I) include 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles, and 1H-pyrazolo[, 1,5-a]benzimidazoles. These compounds are represented by formulae (III), (IV), (V), (VI), (VII) and (VIII) shown below, respectively, and in these compounds, the compounds represented by formulae (v) and (vI) are particularly preferred.

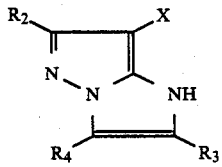

(III)

-continued

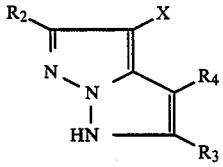

(IV)

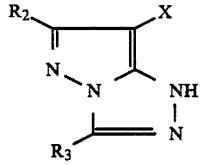

(V)

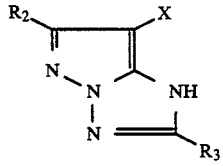

(VI)

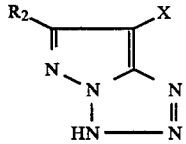

(VII)

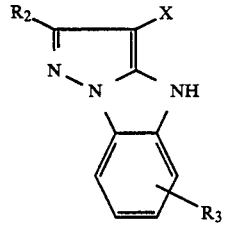

(VIII)

In formulae (III) to (VIII) described above, $R_2$, $R_3$ and $R_4$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X represents a hydrogen atom, a halogen atom, a carboxy group or a group which is bonded to the carbon atom at the coupling position through an oxygen atom, a nitrogen atom or a sulfur atom, and is released by coupling reaction.

The compounds of formulae (III) to (VIII) shown above include the case that $R_2$, $R_3$, $R_4$ or X forms a divalent group and the compound forms a bis compound at the divalent group. Also, when the moiety represented by formula (III) to (VIII) is in the vinyl monomer, said $R_2$, $R_3$ or $R_4$ represents a single bond or a linking group and in this case the moiety represented by formulae (III) to VIII) is bonded to a vinyl group through the bond or linking group.

Preferably, $R_2$, $R_3$ and $R_4$ each represents a hydrogen atom, a halogen atom (e.g., a chlorine atom, a bromine atom, etc.), an alkyl group (e.g., a methyl group, a propyl group, a t-butyl group, a trifluoromethyl grcup, a tridecyl group, a 3-(2,4-di-t-amylphenoxy)propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t butylphenoxy group, etc.), a heterocyclic oxy group (e.g., a 2-benzimidazolyloxy group, etc.), an acyloxy group (e.g., an acetcxy group, a hexadecanoyloxy group, etc.), a cartamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonloxy group, etc. , an acylamino group (e.g., an acetamido group, a benzamido group, a tetradecanamido group, an α-(2,4-di-t-amylphcnoxy) butyramido group, a γ-(3-t-butyl-4-hydroxyphenoxy)butylamino group, an α-[4-(4-hydroxyphenylsulfonyl)phenoxy]decanamido group, etc.), an anilino group (e.g., a phenylamino group, a 2-chloroanilino group, a 2-chloro-5-tetradecananilino group, a 2-chloro-5-dodecyloxycarbonylanilino group, an N-acetylanilino group, a 2-chloro-5-[α-(3-t-butyl-4-hydroxyphenoxy)dodecanamido]anilino group, etc.), a ureido group (e.g., a phenylureido grcup, a methylureido group, an N,N-dibutylureido grcup, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), a carbamoylamino group (e.g., an N-ethylcarbamoylamino group, an N,N-dimethylcarbamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecanamidophenylthio group, etc. , a heterocyclic thio group (e.g., a 2-benzothiazolylthio group, etc.), an alkoxycarbonylamino grcup (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecane-sulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)prcpyl]carbamoyl group, etc.), an acyl group (e.g., an acetyl group, a (2,4-di-tert-amylPhenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group e.g., a methoxycarbonyl group, a butyloxycarbonyl group, a dcdecyloxycarbonyl group, an octadecyloxycarbonyl group, etc.), or an aryloxycarbonyl group (e.g., a phenyloxycarbonyl group, a 3-pentadecylphenyloxycarbonyl group, etc.).

Also, X represents a hydrogen atom, a halogen atom (e.g., a chlorine atom, a bromine arom, an iodine atom, etc.), a carboxy group, a group which is bonded to the carbon atom at the coupling position by an oxygen atom (e.g., an acetoxy group, a propanoyloxy group, a benzoyloxy group, a 2,4-dichlorobenzoyloxy group, an ethoxyoxaloyloxy group, a pyruvinyloxy group, a cinnamoylcxy group, a phenoxy group, a 4-cyanophenoxy group, a 4-methanesulfonamidophenoxy group, a 4-methanesulfonylphenoxy group, an o-naphthoxy group, a 3-pentadecylphenoxy group, a benzyloxycarbonyloxy group, an ethoxy grcup, a 2-cyanoethoxy group, a benzyloxy group, a 2-phenethyloxy group, a 2-phenoxyethoxy group, a 5-phenyltetrazolyloxy group, a 2-benzothiazolyloxy group, a 2-benzothiazolylcxy group, etc.), a group which is bonded by a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydantoinyl group, a 2N-1,1-dioxo-3(2H)-oxo-1,2-benzoisoisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-tetrazol-1yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.), or a group which is bonded by a sulfur atom (e.g., a phenylthic group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

As described above, the compounds represented by formulae (III) to (VIII) described above include the case where $R_2$, $R_3$, $R_4$ or X forms a divalent group and the compound forms a bis compound at the divalent group. Examples of the divalent group include a substituted or unsubstituted alkylene group (e.g., a methylene group, an ethylene group, a 1,10-decylene group, $—CH_2CH_2—O—CH_2CH_2—$, etc.), a substituted or unsubstituted phenylene group (e.g., a 1,4-phenylene group, a 1,3-phenylene group,

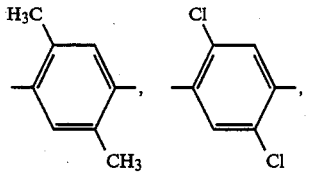

etc.) and —NHCO—$R_5$—CONH— (wherein $R_5$ represents a substituted or unsubstituted alkylene or phenylene group).

Also, when the moiety represented by formulae (III) to (VIII) is in the vinyl monomer, examples of the linking group represented by $R_2$, $R_3$ or $R_4$ include the groups formed by the combination of the groups selected from a substituted or unsubstituted alkylene group (e.g., a methylene group, an ethylene group, a 1,10-decylene group, —$CH_2CH_2OCH_2CH_2$—, etc.), a substituted or unsubstituted phenylene group (e.g., a 1,4-phenylene group, a 1,3-phenylene group,

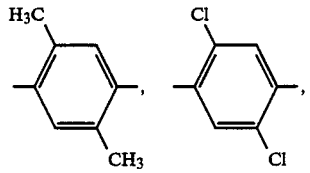

etc.), —NHCO—, —CONH—, —O—, —OCO— and an aralkylene group (e.g.,

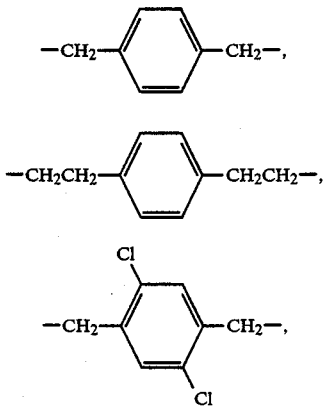

etc.).

In addition, the vinyl group in the vinyl monomer may have a substituent in addition to the morety represented by formulae (III) to (VIII) described above. Examples of the preferred substituent for the vinyl group other than the moiety represented by formulae (III) to (VIII) include a hydrogen atcm, a chlorine atom, or a lower alkyl group having 1 to 4 carbon atoms.

As described above, the polymer coupler includes a copolymer of the vinyl monomer and a non-coloring ethylenical monomer which does not cause coupling reaction with the oxidation product of an aromatic primary amine developing agent. Examples of the non-coloring ethylenical monomer include acrylic acid, α-chloroacrylic acid, α-alkylacrylic acid (e.g., methacrylic acid, etc.), and esters and amides derived from these acrylic acids (e.g., acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacryate, n-butyl methacrylate, β-hydroxy methacrylate, etc. , methylenedibisacrylamide, vinyl esters (e.g., vinyl acetate, vinyl propionate, vinyl laurate, etc.), acrylonitrile, methacrylonitrile, aromatic vinyl compounds (e.g., styrene and the derivatives thereof, vinyltoluene, divinylbenzene, vinylacetophenone, sulfostyrene, etc.), itaconic acid, citraconic acid, crotonic acid, vinylidene chloride, vinyl alkyl ethers (e.g., vinyl ethyl ether, etc.), maleic acid, maleic anhydride, maleic acid esters, N-vinyl-2-pyrrolidone, N-vinylpyridine, 2- or 4-vinylpyridine, etc.). In this case, two or more kinds of the non-coloring ethylenical monomers may be used.

Specific examples and the methods for producing the couplers represented by formulae (III) to (VIII) described above are described in the following literature.

That is, the compounds represented by formula (III) are described in Japanese Patent Application (OPI) Nc. 162548/84, the compounds represented by formula (IV) are described in Japanese Patent Application (OPI) No. 43659/85, the compounds represented by formula (V) are described in Japanese Patent Publication No. 27411/72, the compounds represented by formula (VI) are described in Japanese Patent Application (OPI) Nos. 171956/84 and 172982/85, the compounds represented by formula (VII) are described in Japanese Patent Application (OPI) No. 33552/85, and the compounds represented by formula (VIII) are described :n U.S. Pat. No. 3,061,432.

Also, the high coloring ballast groups described in Japanese Patent Application (OPI) Nos. 42045/83, 214854/84, 177553/84, 177554/84, 177557/84, etc., can be applied to the compounds represented by formulae III) to (VIII) described above.

Specific examples of the pyrazoloazole series couplers represented by the above-described formulae, which can be used in the present invention, are illustrated below although the invention is not limited to these compounds.

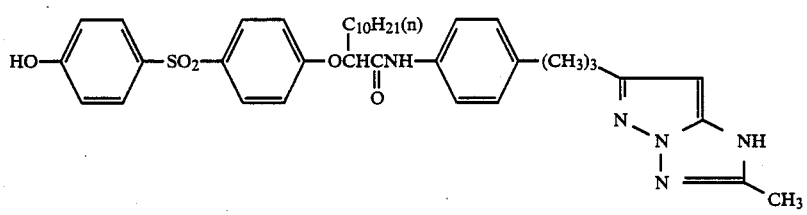

(M-1)

-continued
(M-2)
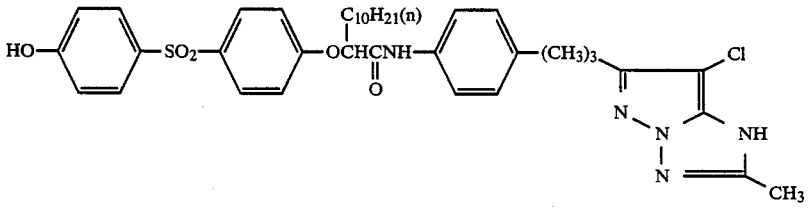
(M-3)
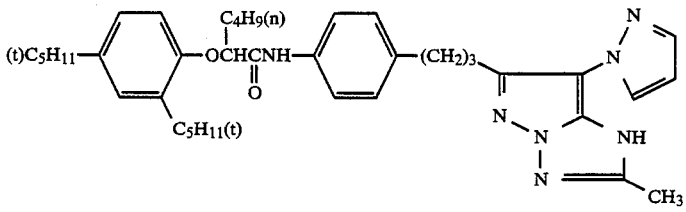
(M-4)
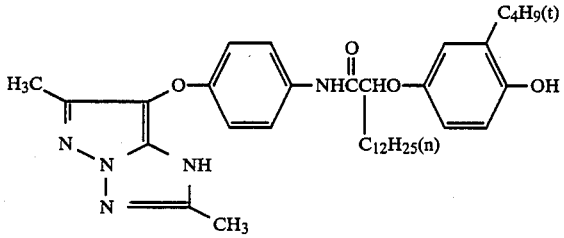
(M-5)
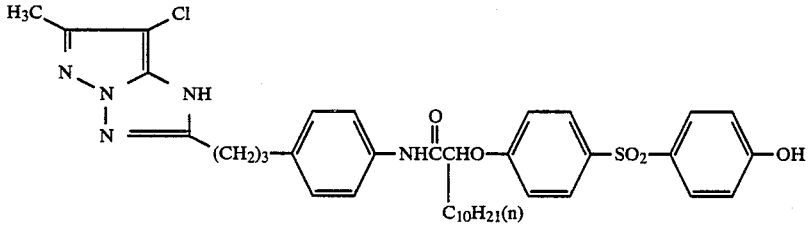
(M-6)
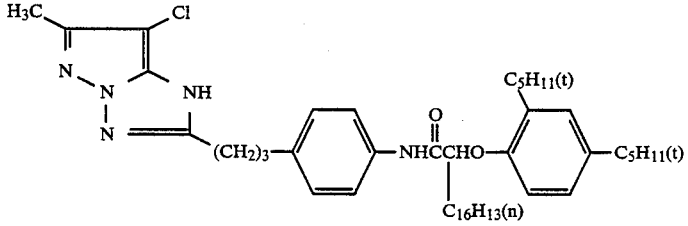
(M-7)
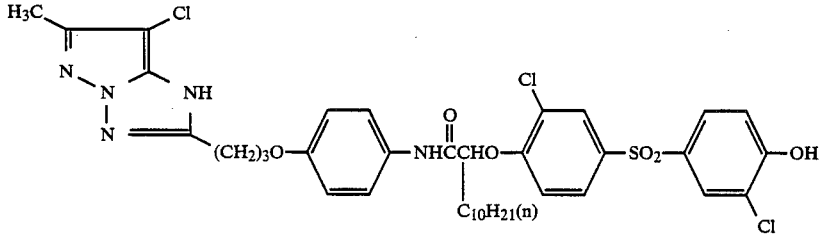
(M-8)
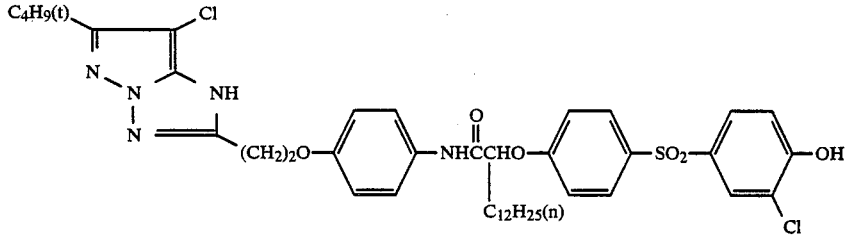

-continued
(M-9)
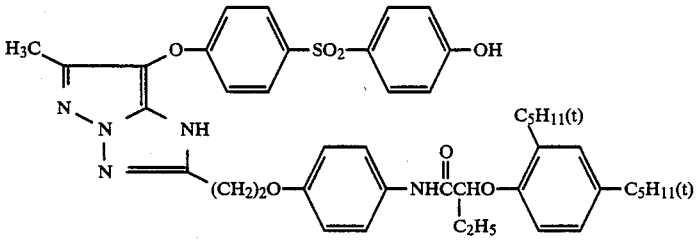
(M-10)
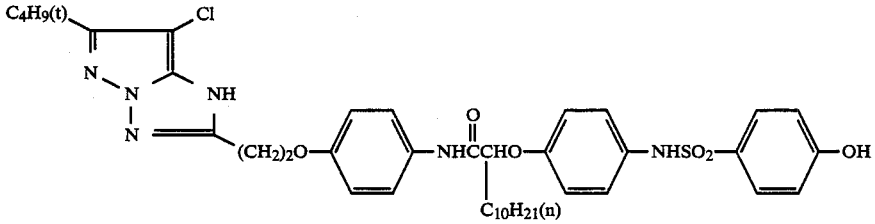
(M-11)
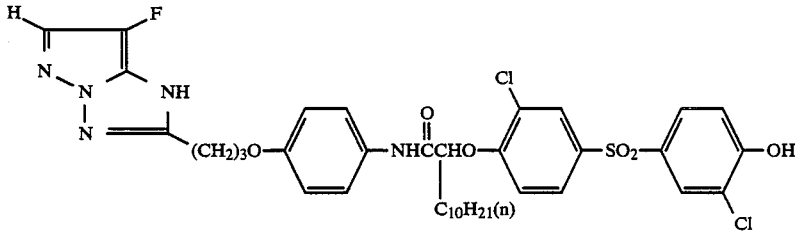
(M-12)
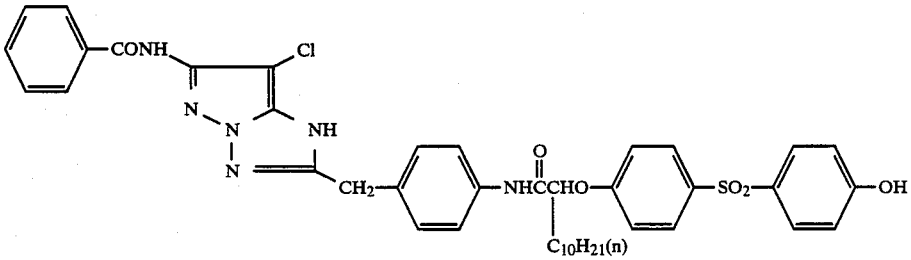
(M-13)
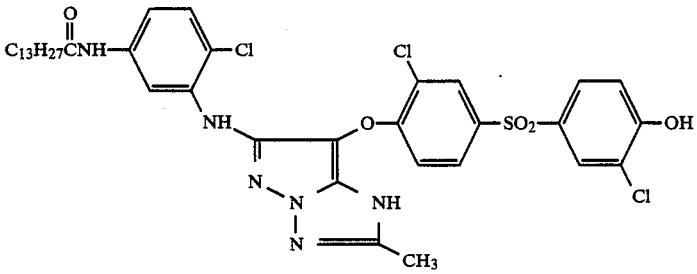
(M-14)
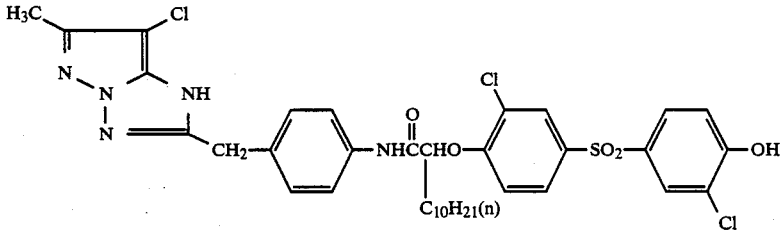

-continued
(M-15)
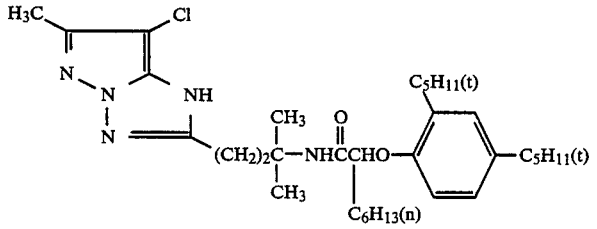
(M-16)
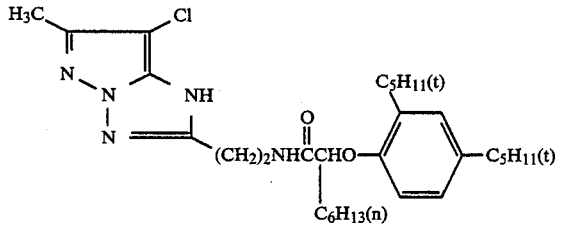
(M-17)
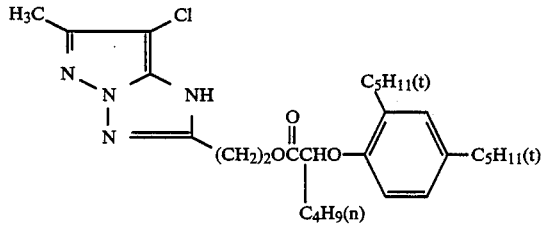
(M-18)
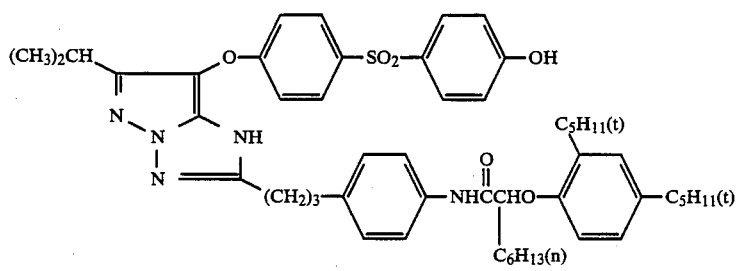
(M-19)
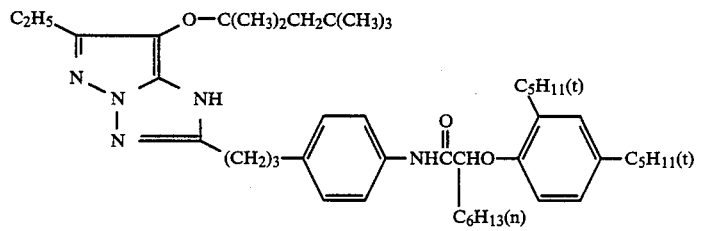
(M-20)
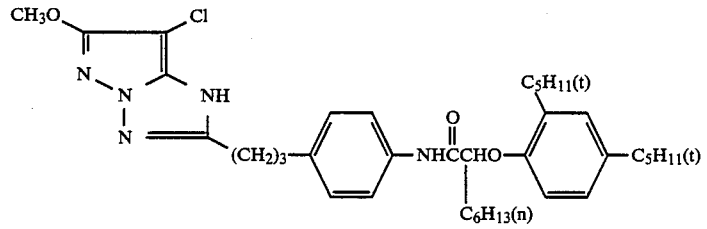
(M-21)
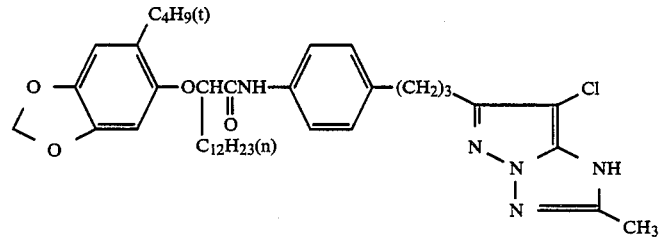

-continued
(M-22)
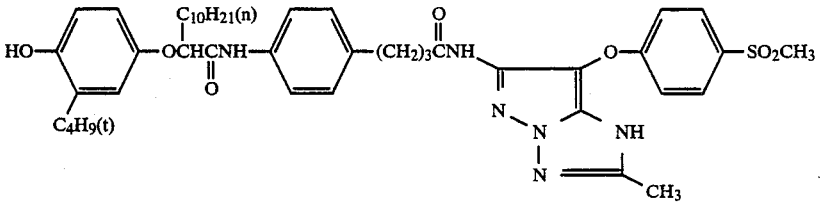
(M-23)
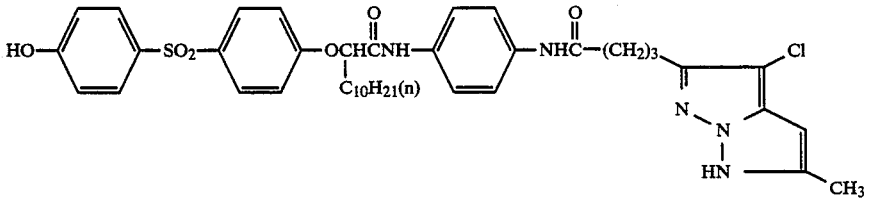
(M-24)
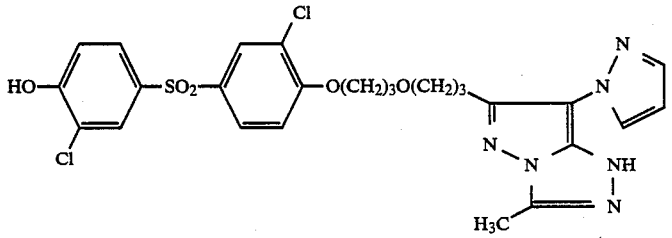
(M-25)
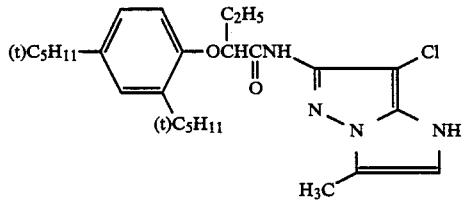
(M-26)
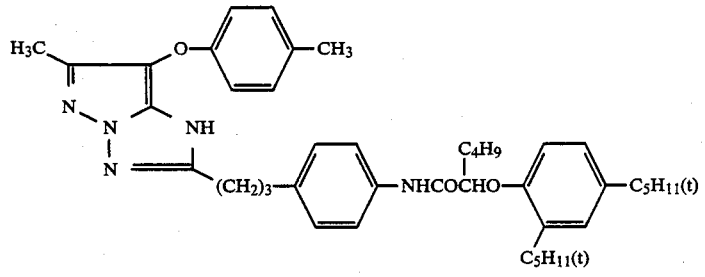
(M-27)
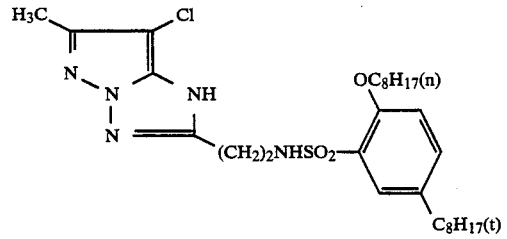
(M-28)
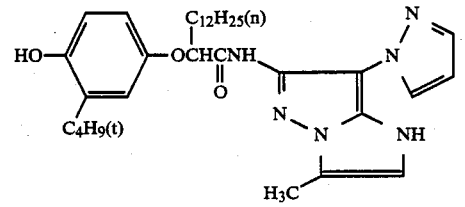

-continued
(M-29)
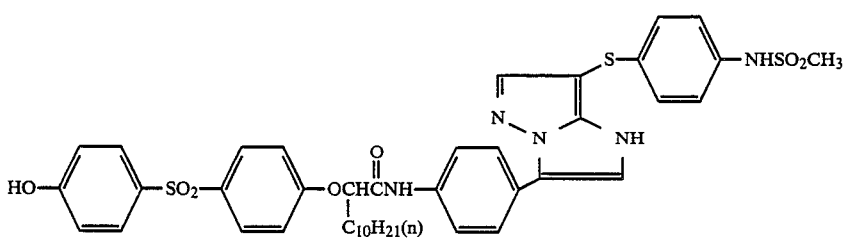
(M-30)
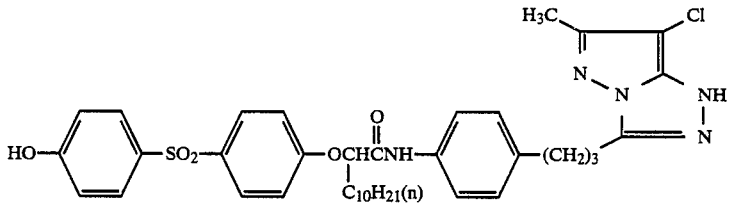
(M-31)
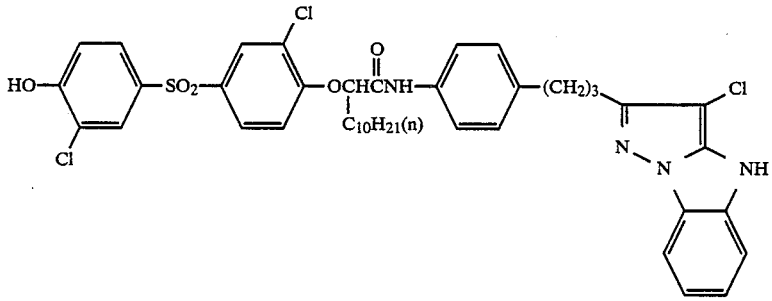
(M-32)
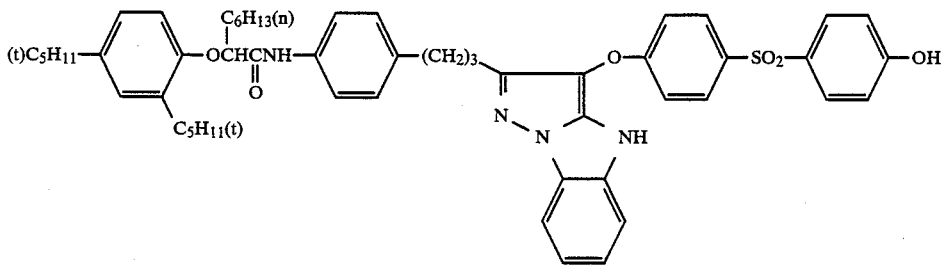
(M-33)
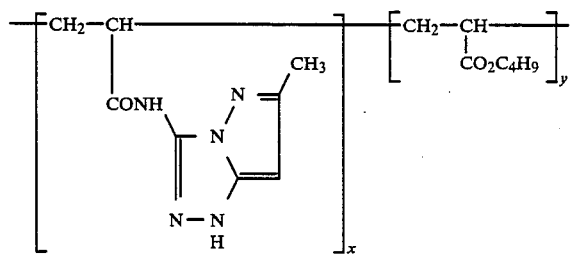
x/y = 50/50 (weight ratio)
(M-34)
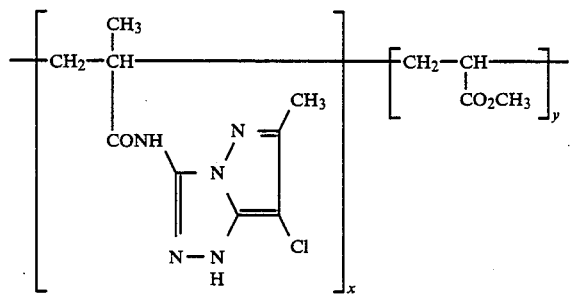
x/y = 40/60 (weight ratio)

-continued
(M-35)
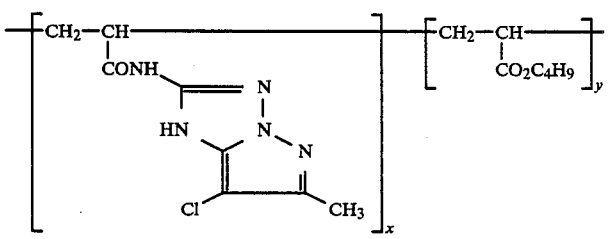
x/y = 50/50 (weight ratio)
(M-36)
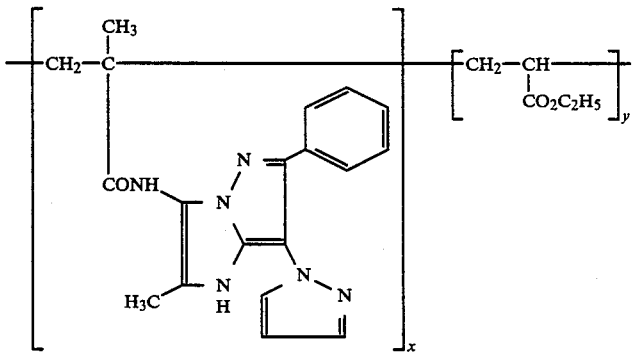
x/y = 55/45 (weight ratio)
(M-37)
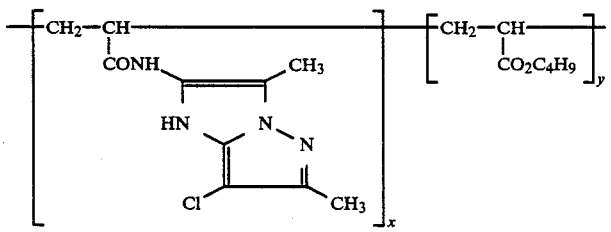
x/y = 50/50 (weight ratio)
(M-38)
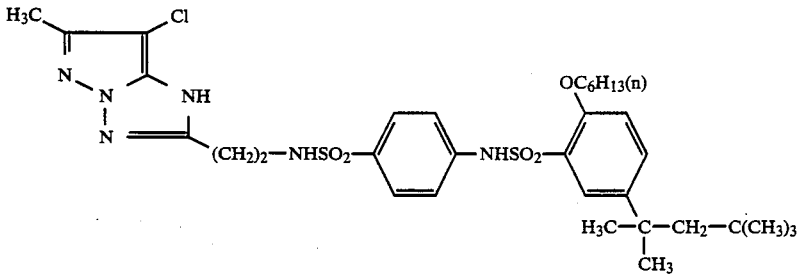
(M-39)
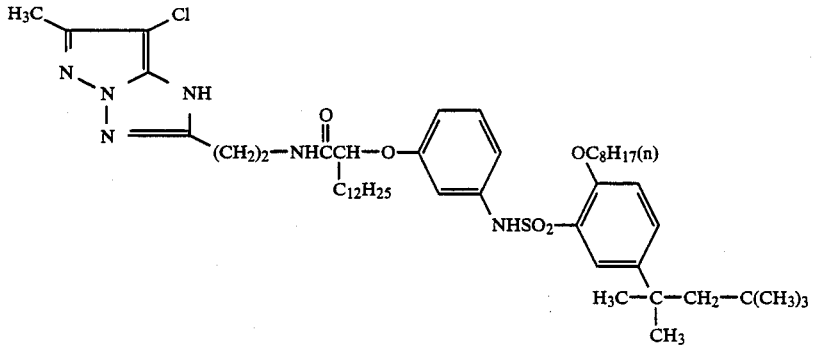

-continued
(M-40)
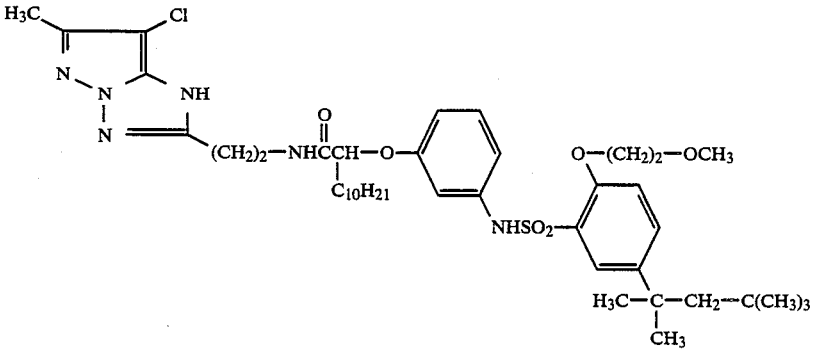
(M-41)
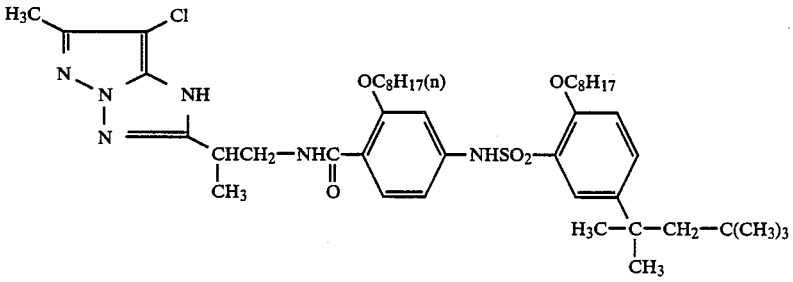
(M-42)
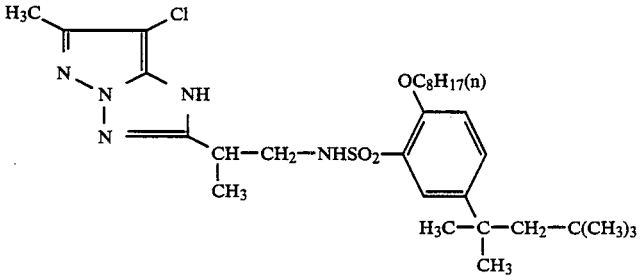
(M-43)
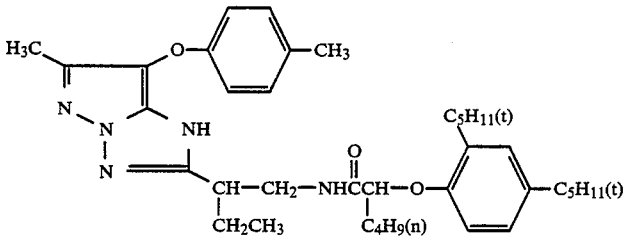
(M-44)
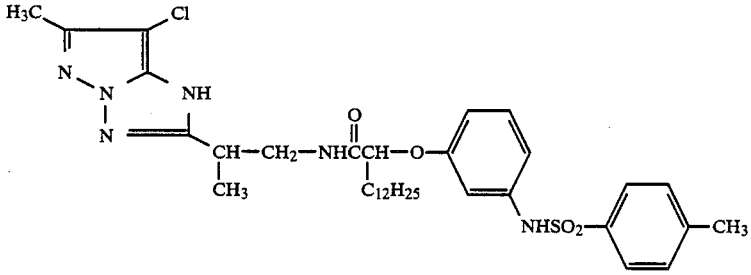

-continued
(M-45)
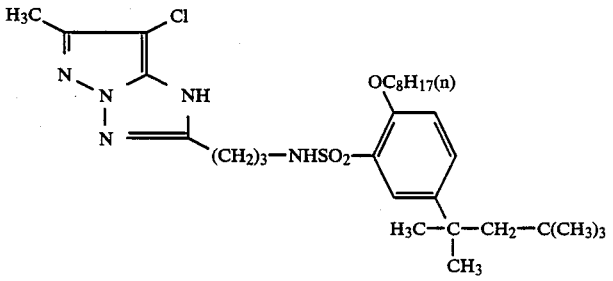
(M-46)
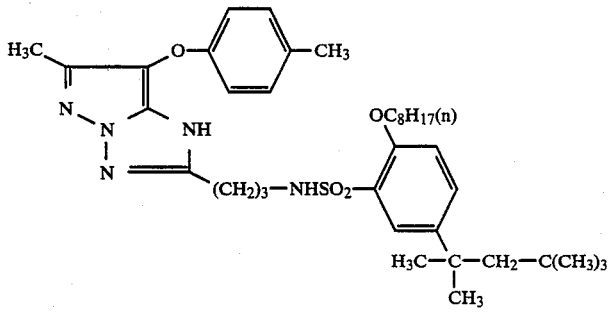
(M-47)
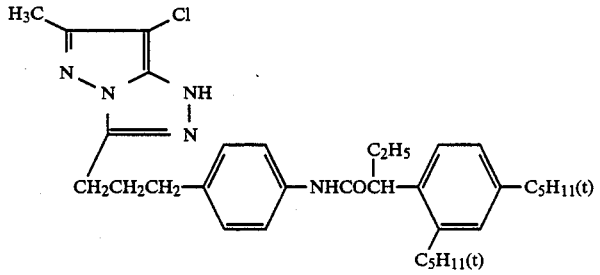
(M-48)
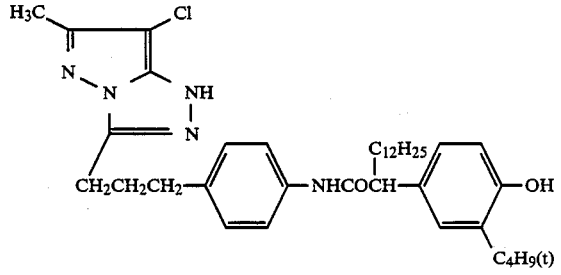
(M-49)
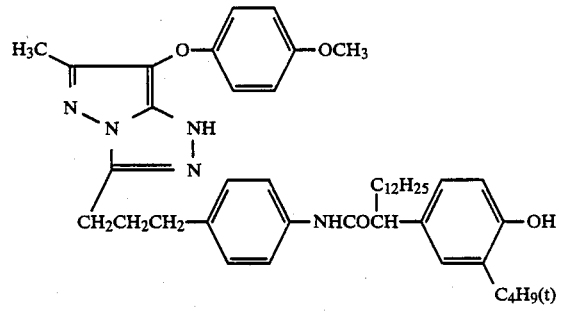

-continued (M-50)

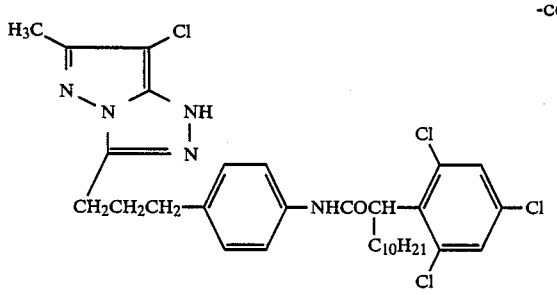

The magenta couplers represented by formula (II) described above are explained in more detail below.

In formula (II), W represents a phenyl group or a naphthyl group substituted by at least one of a halogen atom, an alkyl group, an alkoxy group, an alkoxycarbonyl group and a cyano group.

The alkyl group represented by Z in formula (II) includes a straight chain or branched chain alkyl, alkenyl, cycloalkyl, aralkyl, or alkynyl group having from 1 to 42 carbon atoms, and these groups may be substituted by a halogen atom, a hydroxy group, a mercapto group, a cyano group, a nitro group, a carboxy group, an aryl group, an alkoxy group, an aryloxy group, a heterocyclic oxy group, an acyloxy group, an alkoxycarbonyloxy group, an aryloxycarbonyloxy group, a silyloxy group, a carbamoyloxy grcup, a phosphoric acid oxy group, an acylamino group, a sulfonamido group, an alkoxycartonylamino group, an aryloxycarbonylamino group, a diacylamino group, a carbamoylamino group, a sulfamoylamino group, an aromatic heterocyclic group (e.g., a pyrazolyl group, an imidazolyl group, a triazolyl group, etc.), an imido group, a monooxo nitrogen-containing heterocyclic group (e.g., a pyridone, saccharin, etc.), an acyl group, an alkoxycarbcnyl group, an aryloxycarbonyl group, a carbamoyl group, a sulfamoyl group, a silyl group, an alkylthio group, an arylthio group, a heterocyclic thio group, a sulfonyl group, an alkenyl group, an anilino group, etc.

The aryl group represented by Z in formula (II) is a phenyl group or a naphthyl group having from 6 to 46 carbon atoms, which may be substituted by an alkyl group or each of the substituents described above with respect to the substituents for the alkyl group.

The heterocyclic group represented by Z in formula (II) is a 5-membered or 6-membered heterocyclic group containing a nitrogen atom, an oxygen atom, and a sulfur atom, solely or simultaneously, and may be condensed with a benzene ring. Typical heterocyclic skeletons for the heterocyclic groups are as follows.

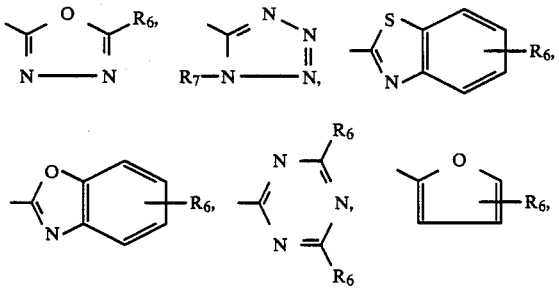

-continued

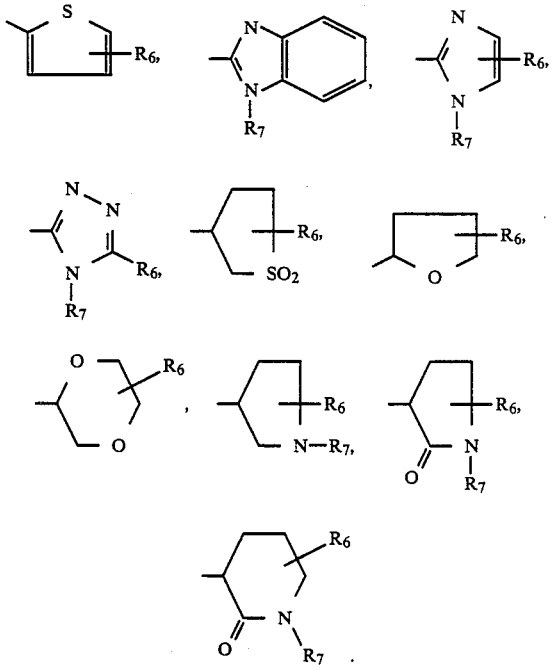

In the above formulae, $R_6$ represents a hydrogen atom, an alkyl grcup, or the substituents described above on the substituents for the alkyl grcup represented by Z, and $R_7$ represents a hydrogen atom, an alkyl group, an aryl group, an acyl group, an alkylsulfonyl group, or an arylsulfonyl group.

Z in formula (II) is preferably an aryl group, which will be described in detail hereinafter.

The acylamino group represented by Y in formula (II) is ar. alkanamido group having 1 to 42 carbon atoms or a benzamido group having 6 to 46 carbon atoms, the ureido group represented by Y is an alkylureido group having from 1 to 42 carbon atoms or a phenylureido group having from 6 to 46 carbon atoms, and the anilino group represented by Y is a phenylamino group having from 6 to 46 carton atoms. The alkyl group for the alkylureido group described above may have a substituent as described above with respect to the substituents for the alkyl group represented by X, and also the phenyl group of the phenylureido group described above with respect to the substituents for the alkyl group represented by X.

Particularly preferred couplers in the 4-mercapto-5-pyrazolone type magenta couplers represented by formula (II) are represented by formula (IX) or (X) described below.

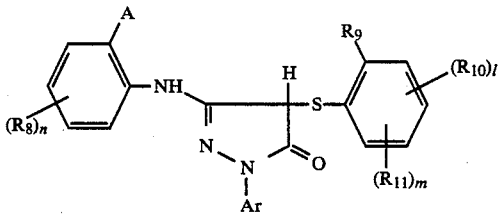

(IX)

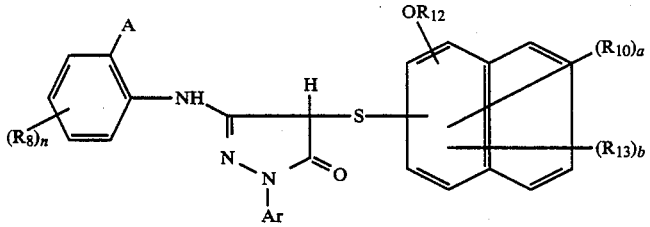

(X)

In formulae (IX) and (X), Ar represents a phenyl group substituted by at least one halogen atom, alkyl group, alkoxy group, alkoxycarbonyl group, or cyano group; A represents a halogen atom or an alkoxy group; $R_8$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arysulfonyl group, an alkylthio group, an arylthio group, an alkyloxycarbonylamino group, a ureido group, an acyl group, a nitro group, or a carboxy group; $R_9$ represents a halogen atom, a hydroxy group, an amino group, an alkyl group, an alkoxy group, an aryloxy group, or an aryl group; $R_{10}$ represents a hydrogen atom, an amino group, an acylamino group, a ureido group, an alkoxycarbonylamino group, an imido group, a sulfonamido group, a sulfamoylamino group, a nitro group, an alkoxycarbonyl group, a carbamoyl group, an acyl group, a cyano group, or an alkylthio group; $R_{11}$ represents a hydrogen atom, a halogen atom, a hydroxy group, an alkyl group, an alkoxy group or an aryl group; at least one of said $R_9$ and $R_{10}$ represents an alkoxy group; m represents an integer of 1 to 3; n represents an integer of 1 to 4; l represents an integer of 1 to 3; $R_{12}$ represents an alkyl group or an aryl group; $R_{13}$ represents a hydrogen atom, a halogen atom, an alkyl group, an alkoxy group, an aryloxy group, or an aryl group, and a and b each represents an integer of 1 to 5.

The couplers represented by formulae (IX) and (X) described above are explained below in further detail.

Ar in these formulae is a substituted phenyl group, and examples of the substituent include a halogen atom (e.g., a chlorine atom, a bromine atom, a fluorine atom, etc. , an alkyl group having from 1 to 22 carbon atoms (e.g., a methyl group, an ethyl group, a tetradecyl group, a t-butyl group, etc.), an alkoxy group having from 1 to 22 carbon atoms (e.g., a methoxy group, an ethoxy group, an octyloxy group, a dodecyloxy group, etc.), ar alkoxycarbonyl group having from 2 to 23 carbon atoms (e.g., a methoxycarbonyl group, an ethoxycarbonyl group, a tetradecyloxycarbonyl group, etc.), or a cyano group.

Z in the formulae represents a halogen atom (e.g., a chlorine atom, a bromine atom, a fluorine atom, etc.) or an alkoxy group having 1 to 22 carbon atoms (e.g., a methoxy group, an octyloxy group, a dodecyloxy group, etc.).

$R_8$ in the formulae represents a hydrogen atom, a halogen atom (e.g., a chlorine atom:, a bromine atom, a fluorine atom, etc.), an alkyl group (e.g., a methyl group, a t-butyl group, a 2-methanesulfonamidoethyl group, a t-butanesulfonylethyl group, a tetradecyl group, etc.), an alkoxy group (e.g., a methoxy group, an ethoxy group, a 2-ethylhexyloxy group, a tetradecyloxy group, etc.), an acylamino group (e.g., an acetamido group, a tenzamido group, a butanamido group, a tetradecanamido group, an α-(2,4-di-tert-amylphenoxy)acetamido group, an α-(2,4-di-tert-amylphenoxy)butyramido group, an α-(3-pentadecylphenoxy)hexanamido group, an α-(4-hydroxy-3-tert-butylphenoxy)tetradecanamido group, a 2-oxo-pyrrolidin-1-yl group, an N-methyltetradecanamido group, an α-(3-methanesulfonamidophenoxy)tetradecanamido group, etc.), a sulfonamido group (e.g., a methanesulfonamido group, a benzenesulfonamido group, a p-toluenesulfonamido group, an octanesulfonamido group, a p-dodecylbenzenesulfonamido group, an N-methyltetradecanesulfonamido group, etc.), a sulfamoyl group (e.g., an N-methylsulfamoyl group, an N-hexadecylsulfamoyl group, an N-(3-dodecyloxypropyl)sulfamoyl group, an N-[4-(2,4-di-tert-amylphenoxy)butyl]sulfamoyl group, an N-methyl-N-tetradecylsulfamoyl group, etc.), a carbamoyl group (e.g., an N-methylcarbamoyl group, an N-octadecylcarbamoyl group, an N-[4-(2,4-di-tert-amylphenoxy)butyl]carbamoyl group, an N-methyl-N-tetradecylcarbamoyl group, etc.), a diacylamino group (e.g., an N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (e.g., a methoxycarbonyl group, a tetradecyloxycarbonyl group, a benzyloxycarbonyl group, etc.), an alkoxysulfonyl group (e.g., a methoxysulfonyl group, an octyloxysulfonyl group, a tetradecyloxysulfonyl group, etc.), an aryloxysulfonyl group (e.g., a phenoxysulfonyl group, a 2,4-di-tert-amylphenoxysulfonyl group, etc.), an alkanesulfonyl-group (e.g., a methanesulfonyl group, an octanesulfonyl group, a 2-erhylhexanesulfonyl group, a hexadecanesulfonyl group, etc.), an arylsulfonyl group (e.g., a benzenesulfonyl group, a 4-nonylbenzenesulfonyl group, etc.), an alkylthio group (e.g., an ethylthio group, a hexylthio group, a benzylthio group, a tetradecylthio group, a 2-(2,4-di-tert-amylphenoxy)ethylthio group, etc.), an arylthio group (e.g., a phenylthio group, a p-tolylthio group, etc.), an alkyloxycarbonylamino group (e.g., ar. ethyloxycarbonylamino group, a benzyloxycarbonylamino, group, a hexanedecyloxycarbonylamino group, etc.), a ureido group (e.g., an N-methylureido group, an N-phenylureido group, an N,N-dimethylureido group, an N-methyl-N-dodecylureido group, an N-hexadecylureido group, an N,N-dioctanedecylureido group, etc.), an acyl group (e.g., an acetyl group, a benzoyl group, an octadecanoyl group, a p-dodecanamidobenzoyl group, etc.), a nitro group, or a carboxy group.

In the above-described groups, the alkyl moiety has 1 to 42 carbon atoms and the aryl moiety has 6 to 46 carbon atoms.

$R_9$ to $R_{11}$ in formulae (IX) and (X) are explained in further detail below.

$R_9$ represents a halogen atom (e.g., a chlorine atom, a bromine atom, etc.), a hydroxy group, a subsituted or unsubstituted amino group (e.g., an N-alkylamino group, an N,N-dialkylamino group, an N-anilino group, an N-alkyl-N-arylamino group, and a heterocyclic amino group, such as an N-butylamino group, an N,N-dibutylamino group, an N,N-dihexylamino group, an N-piperidino group, an N,N-bis(2-dodecyloxyethyl-)amino group, an N-cyclohexylamino group, an N-phenylamino group, an N,N-bis(2-hexanesulfonylethyl-)amino group, etc.), an alkyl group (e.g., a straight chain or branched alkyl group, an aralkyl group, an alkenyl group, a cycloalkyl group, or a cycloalkenyl group, such as a methyl group, a butyl group, an octyl group, a dodecyloxy group, a benzyl group, a cyclopentyl group, a 2-methanesulfonylethyl group, a 3-phenoxypropyl group, etc.), an alkoxy group (e.g., a methoxy group, a butoxy group, a benzyloxy group, a 2-ethylhexyloxy group, a dodecyloxy group, a 2-methanesulfonylethyloxy group, a 2-butanesulfonylethyloxy group, an isopropyloxy group, a 2-chloroethyloxy group, a 3-(2,4-di-tert-amylphenoxy)propyloxy group, a 2-(N-methylcarbamoyl)ethoxy group, a cyclopentyloxy group, a 2-ethoxytetradecyloxy group, a 4,4,4,3,3,2,2-heptafluorobutyloxy group, a 3-(N-butylcarbamoyl)-propyloxy group, a 3-(N,N-dimethylcarbamoyl)-propyloxy group, a 4-methanesulfonylbutoxy group, a 2ethanesulfonamidoethyloxy group, etc.), an aryloxy group (e.g., a phenoxy group, a 2,4-dichlorophenoxy group, etc.), or an aryl group (substituted or unsubstituted phenyl group, and an $\alpha$- or $\beta$-naphthyl group having from 6 to 38 carbon atoms, such as a phenyl group, an $\alpha$- or $\beta$-naphthyl group, a 4-chlorophenyl group, a 4-t-butylphenyl group, a methanesulfonamidophenyl group, a 2,4-dimethylphenyl group, etc.).

$R_{10}$ in these formulae represents a hydrogen atom, a substituted or unsubstituted amino group (e.g., an N-alkylamino group, an N,N-dialkylamino group, an N-anilino group, an N-alkyl-N-arylamino group, and a heterocyclic amino group, such as an N-butylamino group, an N,N-diethylamino group, an N-[2-(2,4-di-tert-amylphenoxy)ethyl]amino group, an N,N-dibutylamino group, an N-piperidino group, an N,N-bis(2-dodecyloxyethyl)amino group, an N-cyclohexylamino group, an N,N-dihexylamino group, an N-phenylamino group, a 2,4-di-tertamylphenylamino group, an N-(2-chloro-5-tetradecanamidophenyl)amino group, an N-methyl-N-phenylamino group, an N-(2-pyridyl)amino group, etc.), an acylamino group (e.g., an acetamido group, a benzamido group, a tetradecanamido group, a (2,4-di-tert-amylphenoxy)acetamido group, a 2-chlorobenzamido group, a 3-pentadecylbenzamido group, a 2-(2-methanesulfonamidophenoxy)dodecanamido group, a 2-(2-chlorophenoxy)tetradecanamido group, etc.), a ureido group e.g., a methylureido group, a phenylureido group, a 4-cyanophenylureido group, etc.), an alkoxycarbonylamino group (e.g., a methoxycarbonylamino group, a dodecyloxycarbonylamino group, a 2-ethylhexyloxycarbonylamino group, etc.), an imido group (e.g., an N-succinimido group, an N-phthalimido group, an N-hydantoinyl group, a 5,5-dimethyl-2,4-dioxooxazol-3-yl group, an N-(3-octadecenyl)succinimido group, etc.), a sulfonamido group (e.g., a methanesulfonamido group, an octanesulfonamido group, a benzenesulfonamido group, a 4-chlorobenzenesulfonamido group, a 4-dodecylbenzenesulfonamido group, an N-methyl-N-benzenesulfonamido group, a 4-dodecyloxybenzenesulfonamido group, a hexadecanesulfonamido group, etc.), a sulfamoylamino group (e.g., an N-octylsulfamoylamino group, an N,N-dipropylsulfamoylamino group, an N-ethyl-N-phenylsulfamoylamino group, an N-(4-butyloxy)sulfamoylamino group, etc.), a nitro group, an alkoxycarbonyl group (e.g., a methoxycarbonyl group, a butoxycarbonyl group, a dodecyloxycarbonyl group, a benzyloxycarbonyl group, etc.), a carbamoyl group (e.g., an N-octylcarbamoyl group, an N,N-dibutylcarbamoyl group, an N-phenylcarbamoyl group, an N-[3-(2,4-di-tert-amylphenoxy)propyl]carbamoyl group, etc.), an acyl group (e.g., an acetyl group, a benzoyl group, a hexanoyl group, a 2-ethylhexanoyl group, a 2ethylhexanoyl group, a 2-chlorobenzoyl group, etc.), a cyano group, or an alkylthio group e.g., a dodecylthio group, a 2-ethylhexylthio group, a benzylthio group, a 2-oxocyclohexylthio group, a 2-(ethyltetradecanoate)thio group, a 2-(dodecylhexanoate)thio group, a 3-phenoxypropylthio group, a 2-dodecanesulfonylethylthio group, etc.).

$R_{11}$ in these formulae described above represents a hydrogen atom, a hydroxy group, or, in addition, a halogen atom, or an alkyl, alkoxy or aryl group as described for $R_9$, and at least one of said $R_9$ and $R_{11}$ represents an alkoxy group.

$R_{12}$ represents an alkyl or aryl group as described above for $R_9$.

$R_{13}$ represents a hydrogen atom, or, in addition, a halogen atom, or an alkyl, alkoxy, aryloxy, or aryl group as described above for $R_9$.

Specific examples of the magenta couplers represented by formula (II) described above are illustrated below, but the invention is not limited thereto.

(M-51)
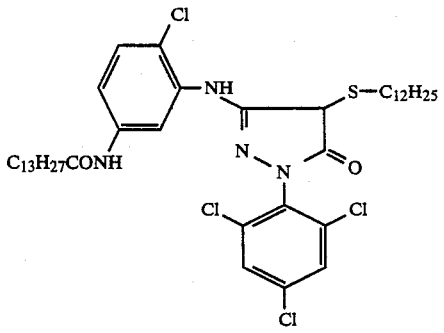
(M-52)
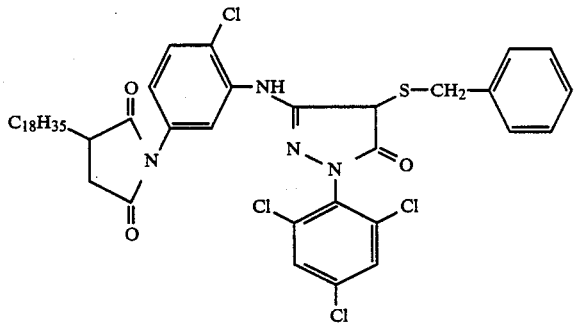
(M-53)
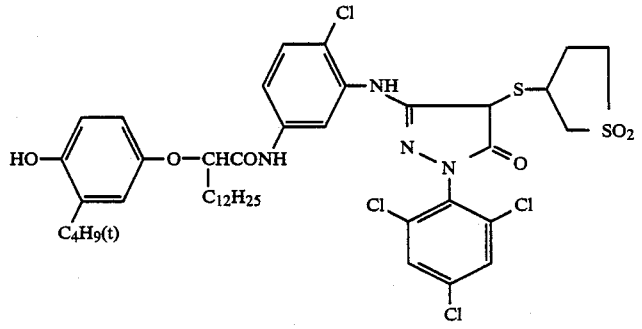
(M-54)
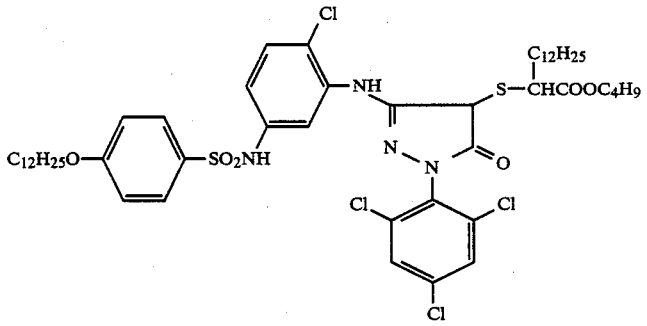
(M-55)
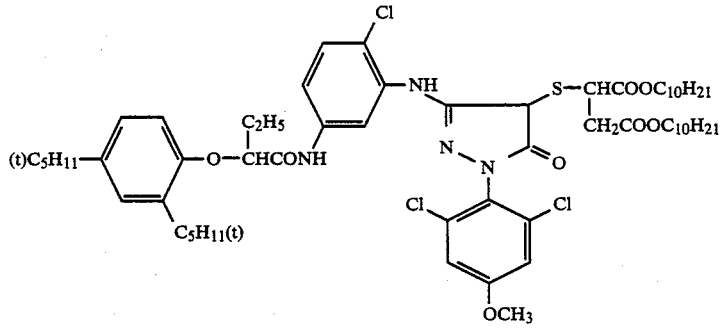

-continued
(M-56)
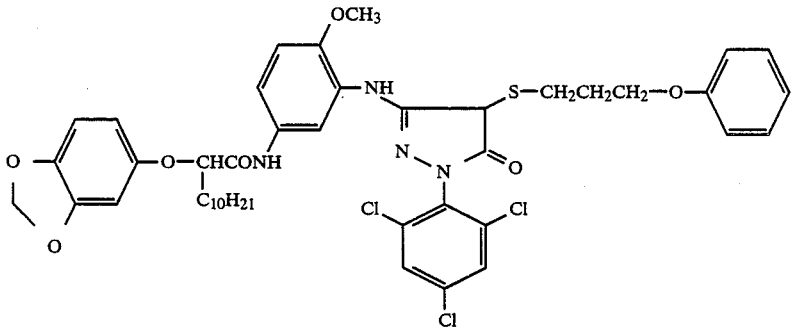
(M-57)
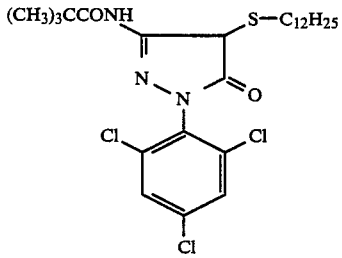
(M-58)
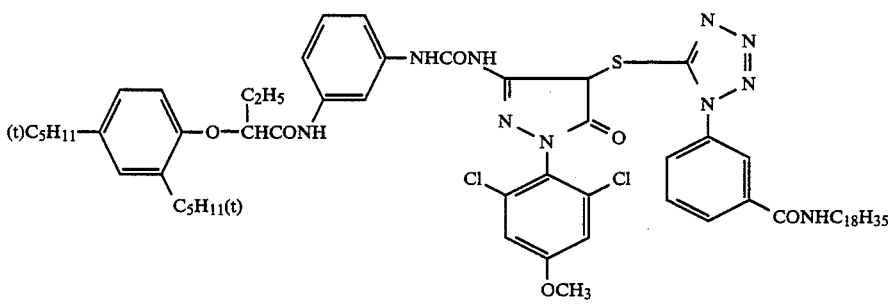
(M-59)
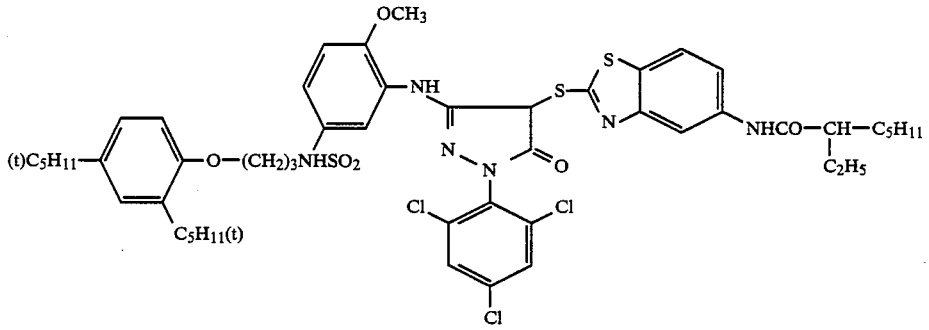
(M-60)
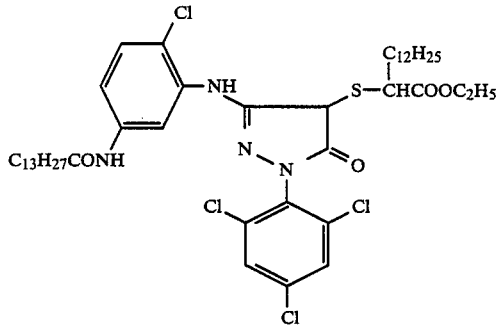

-continued
(M-61)
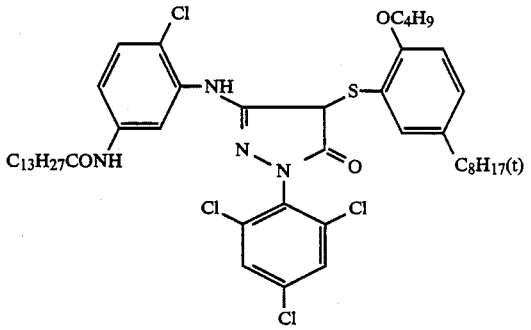
(M-62)
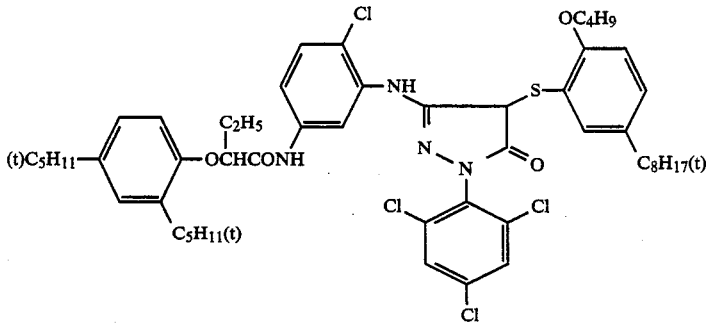
(M-63)
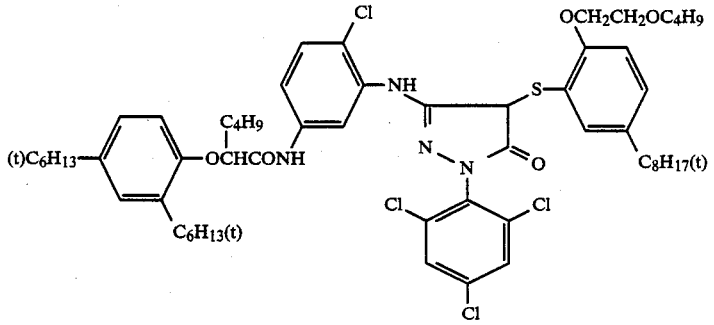
(M-64)
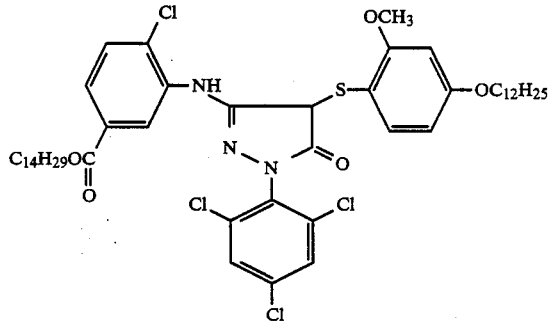
(M-65)
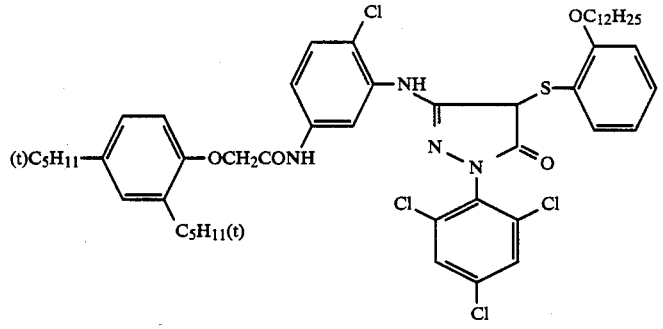

-continued
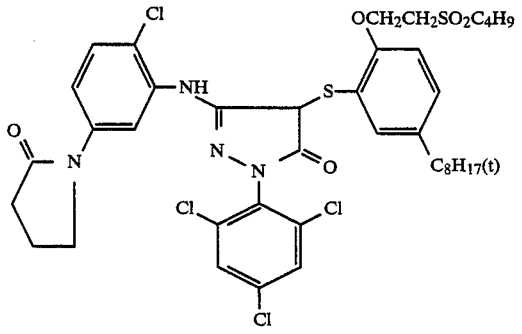
(M-66)
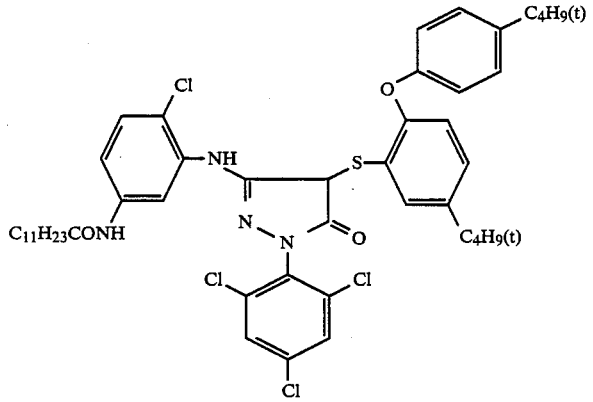
(M-67)
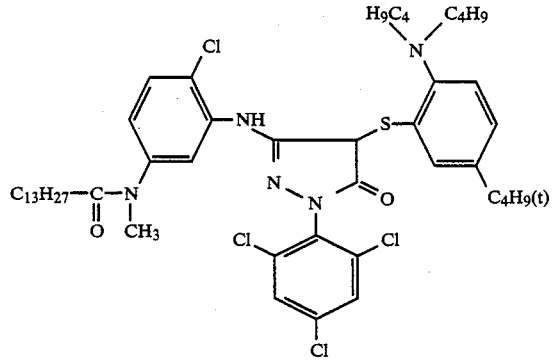
(M-68)
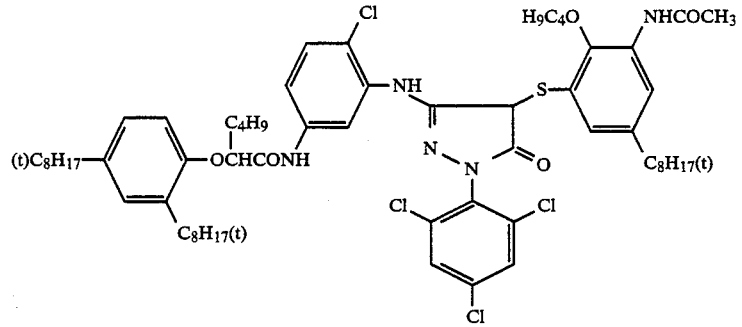
(M-69)

-continued
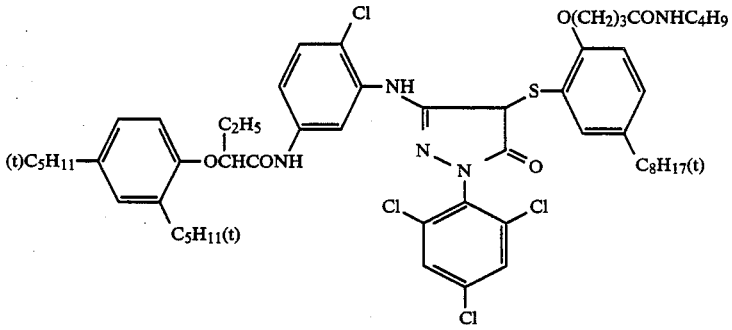
(M-70)
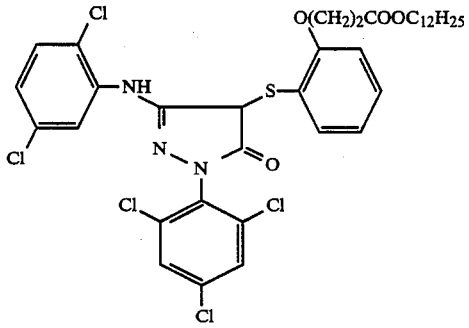
(M-71)
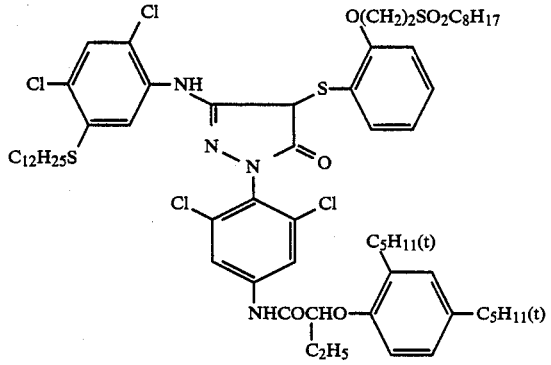
(M-72)
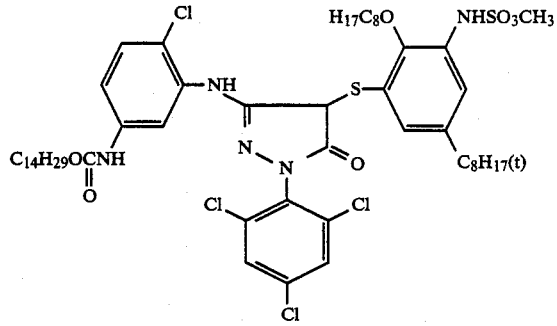
(M-73)

-continued
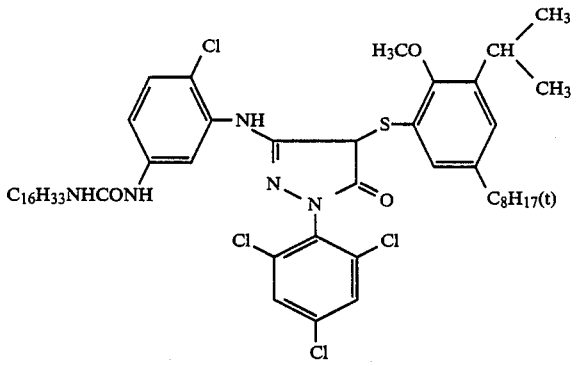
(M-74)
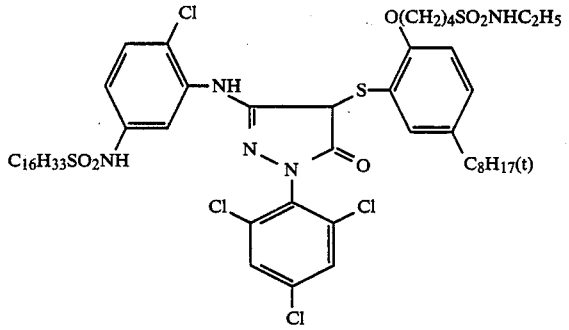
(M-75)
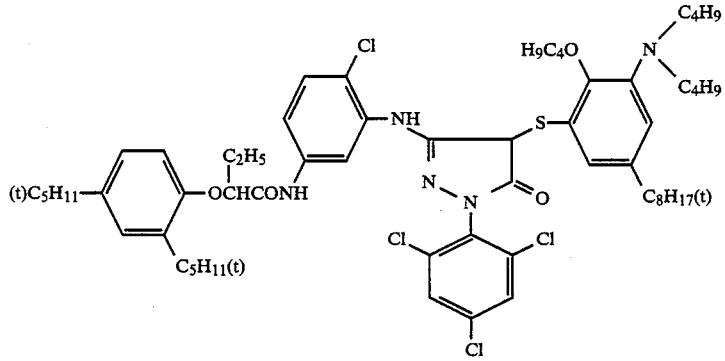
(M-76)
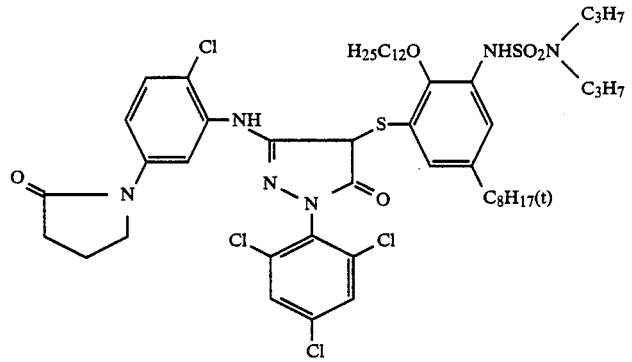
(M-77)

-continued
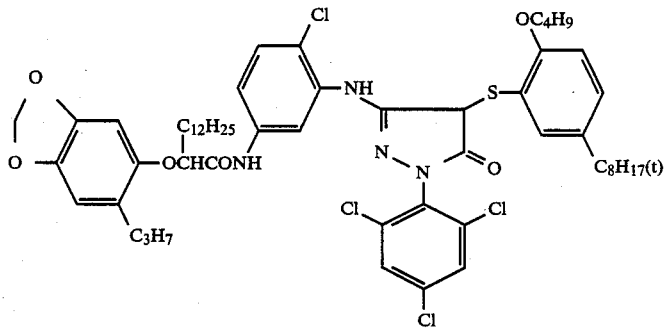
(M-78)
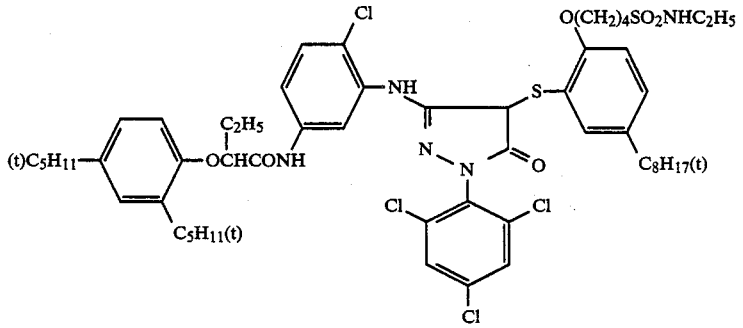
(M-79)
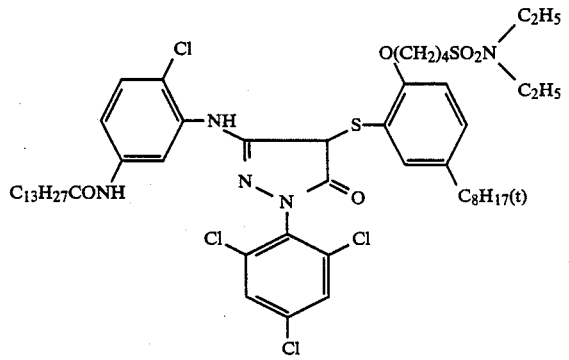
(M-80)
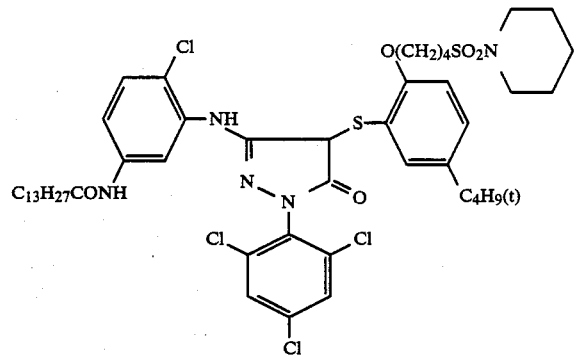
(M-81)

-continued
(M-82)
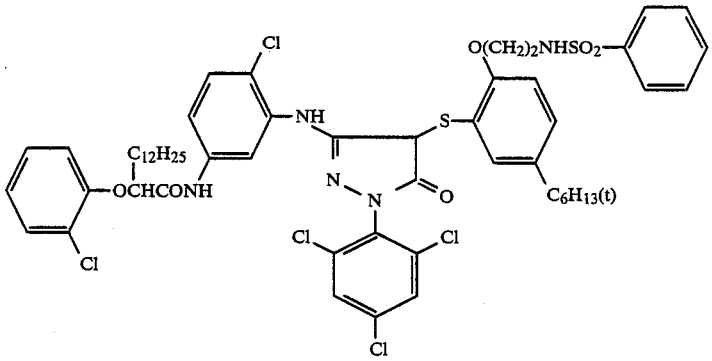
(M-83)
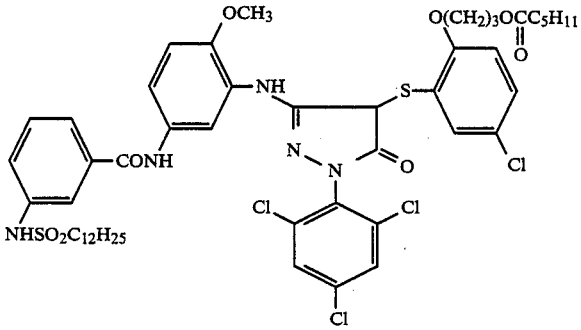
(M-84)
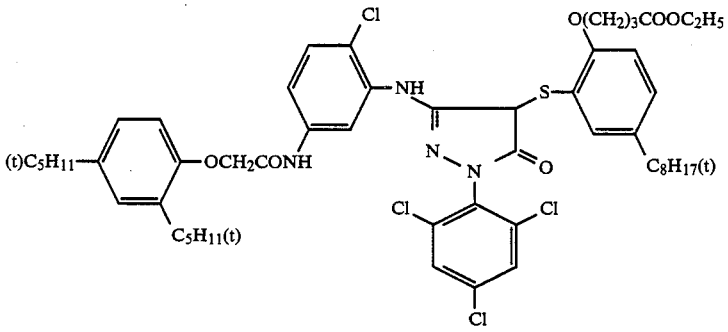
(M-85)
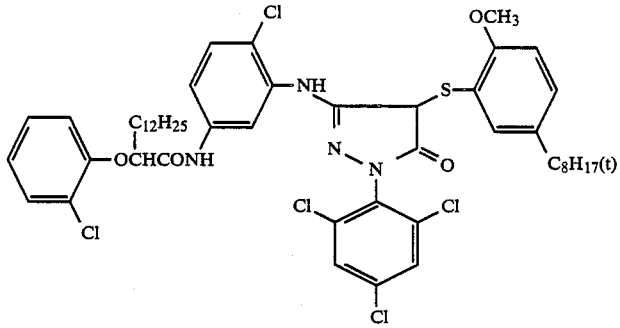

-continued

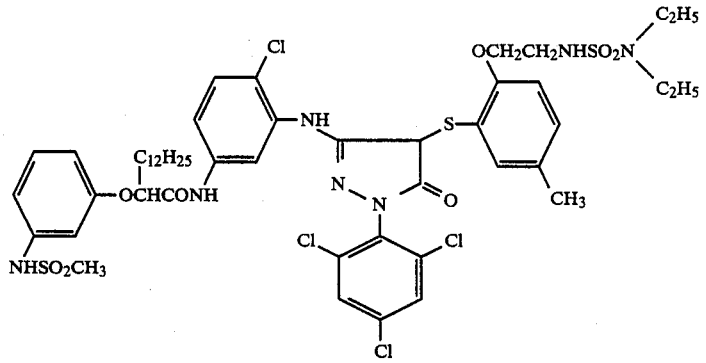

(M-86)

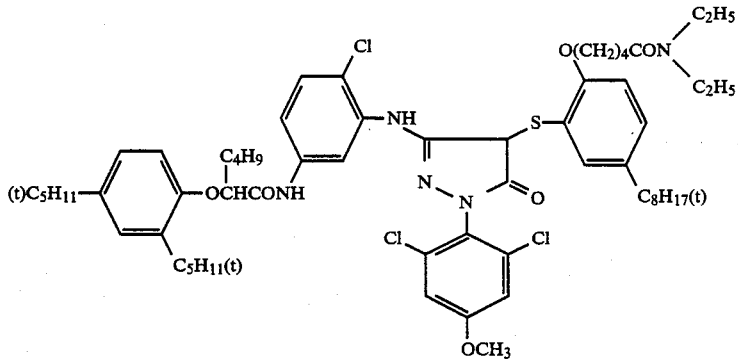

(M-87)

The magenta couplers for use in this invention represented by formula (II) described above can be synthesized according to the methods described, for example, in Japanese Patent Publication No. 34044/78, Japanese Patent Application (OPI) No. 62454;80, U.S. Pat. No. 3,701,783, etc.

These couplers are each present in a silver halide emulsion layer generally from $2\times10^{-3}$ to $5\times10^{-1}$ mol, and preferably from $1\times10^{-2}$ to $5\times10^{-1}$ mol, per mol of silver in the emulsion layer.

The above-described magenta couplers may be present in one emulsion layer as a combination of two or more kinds thereof, or a single coupler may be present in two or more emulsion layers, in order to satisfy the characteristics required for a particular color photographic graphic material.

The above-described magenta coupler(s) can be introduced into a silver halide emulsion by an oil-in-water dispersion method or the method described in U.S. Pat. No. 2,322,027. For example, the magenta coupler is dispersed in a hydrophilic colloid layer as fine oil drops thereof in the existence of a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyllaurylamide, etc.), an aliphatic ester (e.g., dibutoxyethyl succinate, diethyl azelate, etc.), trimesic acid ester (e.g., tributyl trimesate, etc.), etc.

The silver halide particles in the silver halide photographic emulsions may be so-called regular particles having a regular crystal form such as cubic, octahedral, tetradecahedral, etc., irregular particles having an irregular crystal form such as spherical, particles having a crystal defect such as twin face, etc., or the particles may have a composite form thereof.

The silver halide particles for use in the present invention may be fine particles having a diameter of the projected area of less than about 0.1 micron or large particles having a diameter of the projected area of up to about 10 microns. The silver halide emulsion for use in the present invention may be a monodispersed emulsion having a narrow particle size distribution, or a polydispersed emulsion having a broad particle size distribution.

Two or more kinds of silver halide emulsions prepared separately may be used as a mixture thereof.

Also, in a typical monodispersed emulsion for use in the present invention, at least about 95% by weight of silver halide particles having a mean particle size of at least about 0.1 micron are in ±40% of the mean particle size of all of the silver halide particles. A silver halide emulsion wherein at least about 95% by weight or by number of silver halide particles having a mean particle size of from about 0.25 to about 2 microns are in the range of ±20% of the mean particle size of all of the silver halide particles can be used in the present invention.

Also, tabular grain silver halide emulsion having an aspect ratio of at least about 5 can be used in the present invention. The tabular silver halide grains can be prepared by the methods described in Gutoll, *Photographic Science and Engineering*, Vol. 14, pp. 248 to 257 (1970), U.S. Pat. Nos. 4,431,226, 4,414,310, 4,433,048, 4,439,520, British Pat. No. 2,112,157, etc. When the tabular grain silver halide emulsion is used, advantages such as the improvement of color sensitizing effect by sensitizing dye(s), the improvement of graininess, and the increase of sharpness can be obtained, as described in detail in U.S. Pat. No. 4,434,226.

The crystal structure of silver halide particles may be homogeneous through the particle, may differ in halogen composition between the inside and the outer portion thereof, or may have a layer structure. These silver halide particles are disclosed in British Pat. No. 1,027,146, U.S. Pat. Nos. 3,505,068, 4,444,877, and Japanese Patent Application (OPI) No. 143331/85. Also, silver halide particles formed by bonding silver halides each having different halogen composition by epitaxial junction may be used in the present invention. Furthermore, a mixture of silver halide particles having various crystal forms can be used.

The silver halide emulsions for use in the present invention may be physically ripened, chemically ripened, and spectrally sensitized. The additives used in these steps are described in *Research Disclosure,* RD No. 17643 (December, 1978) and ibid., RD No. 18716 (November, 1979) and the corresponding portions are shown in the following table.

Also, known photographic additives which can be used in the present invention are also described in the above-described two Research Disclosures the portions thereof indicated in the table below.

| Additive | RD No. 17643 | RD No. 18716 |
|---|---|---|
| 1. Chemical Sensitizer | Page 23 | Page 648, right column |
| 2. Sensitivity Increasing Agent | Page 23 | Page 648, right column |
| 3. Spectral Sensitizer and Super Color Sensitizer | Pages 23 and 24 | Page 648, right column to page 649, right column |
| 4. Whitening Agent | Page 24 | |
| 5. Antifoggant and Stabilizer | Pages 24 and 25 | Page 649, right column |
| 6. Light Absorbent, Filter Dye, Ultraviolet Absorbent | Pages 25 and 26 | Page 649, right column to page 650, left column |
| 7. Stain Preventing Agent | Page 25, right column | Page 650, left to right column |
| 8. Dye Image Stabilizer | Page 25 | |
| 9. Hardener | Page 26 | Page 651, left column |
| 10. Binder | Page 26 | Page 651, left column |
| 11. Plasticizer, Lubricant | Page 27 | Page 650, right column |
| 12. Coating Aid, Surface Active Agent | Pages 26 and 27 | Page 650, right column |
| 13. Antistatic Agent | Page 27 | Page 650, right column |

Examples of the typical yellow coupler for use in the present invention include hydrophobic acylacetamide series couplers having a ballast group. Specific examples of these yellow couplers are described, for example, in U.S. Pat. Nos. 2,407,210, 2,875,057 and 3,265,506.

In the present invention 2-equivalent yellow couplers are preferably used, and examples of such couplers include oxygen atom releasing type yellow couplers as described in U.S. Pat. Nos. 3,408,194, 3,447,928, 3,933,501, 4,022,620, etc., and nitrogen atom releasing type yellow couplers as described in Japanese Patent Publication No. 10739/83, U.S. Pat. Nos. 4,401,752, 4,326,024, *Research Disclosure,* RD No. 18053 (April, 1979), British Pat. No. 1,425,020, West German Patent Application (OLS) Nos. 2,219,917, 2,261,361, 2,329,587, 2,433,812, etc.

Also, α-pivaloylacetanilide series couplers are excellent in fastness, particularly light fastness of colored dyes obtained therewith. On the other hand, α-benzoylacetanilide series couplers give high coloring density.

Examples of the cyan couplers for use in the present invention include hydrophobic and nondiffusible naphtholic or phenolic couplers, such as the naphtholic couplers described in U.S. Pat. No. 2,474,293, and preferably the oxygen atom releasing type 2-equivalent naphtholic couplers as described in U.S. Pat. Nos. 4,052,212, 4,146,396, 4,228,233, and 4,296,200.

Specific examples of the phenolic couplers are described in U.S. Pat. Nos. 2,369,929, 2,801,171, 2,772,162, 2,895,826, etc. Cyan couplers capable of forming cyan dyes having high fastness to humidity and temperature are preferably used in the present invention, and specific examples of these cyan couplers are the phenolic cyan couplers having an alkyl group having two or more carbon atoms at the meta-position of the phenol nucleus as described in U.S. Pat. No. 3,772,002, etc., the 2,5-diacylamino-substituted phenolic couplers as described in U.S. Pat. Nos. 2,772,162, 3,758,308, 4,126,396, 4,334,011, 4,327,175, West German Patent Application (OLS) No. 3,329,729, European Pat. No. 121,365, etc., the phenolic cyan couplers having a phenylureido group at the 2-position and an acylamino group at the 5-position as described in U.S. Pat. Nos. 3,446,622, 4,333,999, 4,451,559, 4,427,767, etc. Furthermore, the naphtholic cyan couplers having a sulfonamido group, an amido group, etc., at the 5-position of the naphthol nucleus described in Japanese Patent Application (OPI) No. 237448/85 are excellent in the fastness of colored images formed and can preferably be used in the present invention.

For correcting unnecessary absorptions of colored dyes, it is preferred to use colored couplers for color photographic materials for photographing in order to provide masking. Typical examples of such colored couplers are the yellow-colored magenta couplers described in U.S. Pat. No. 4,162,670, Japanese Patets Publication No. 39413/82, etc., and the magenta-colored cyan couplers described in U.S. Pat. Nos. 4,004,929, 4,138,258, British Pat. No. 1,146,368, etc. Other examples of the colored couplers for use in the present invention are described in *Research Disclosure,* RD No. 17643 (December, 1978), Paragraph VII-G.

In the present invention, the graininess can be improved by using couplers providing colored dyes having suitable diffusibility can be used.together with the above-described couplers. Specific examples of such couplers include magenta couplers described in U.S. Pat. No. 4,366,237 and British Pat. No. 2,125,570, etc., and yellow, magenta and cyan couplers in European Pat. No. 96,570 and West German Patent Application (OLS) No. 3,234,533.

The dye-forming couplers and the special couplers described above may form a polymer including a dimer or more. Specific examples of the polymerized dye-forming couplers are described in U.S. Pat. Nos. 3,451,920 and 4,080,211. Also, specific examples of polymerized magenta couplers are described in British Pat. No. 2,102,173 and U.S. Pat. No. 4,367,282.

Couplers releasing photographically useful residues upon coupling can also be preferably used in the present invention. DIR couplers, e.g., couplers releasing a development inhibitor, are described in *Research Disclosure,* RD No. 17653 (December, 1978), Paragraph VII-F.

Examples of the supports which can be used in the present invention are described in *Research Disclosure,* RD No. 17643, page 28 and ibid., RD No. 18716, page 647, right column to page 648, left column.

The process of the present invention can be applied to various kinds of color photographic materials such as cinematic color negative photographic films, color reversal photographic films for lantern slide or television, color photographic papers, color positive photographic films, color reversal photographic papers, etc. The present invention can also be applied to black-and-white photographic materials utilizing a mixture of three color couplers, as described in *Research Disclosure,* RD No. 17123 (July, 1978).

The following examples are intended to illustrate the present invention but not to limit it in any way.

EXAMPLE 1

A color photographic paper, Fuji Color Paper Type 12 (made by Fuji Photo Film Co., Ltd.) was imagewise exposed and was processed by continuous development processing under the following conditions using Fuji Color Roll Processor FMPP 1000 (made by Fuji Photo Film Co., Ltd.).

| Step | Time | Temperature | Tank Capacity (l) | Amount of Replenisher (ml/m$^2$) |
|---|---|---|---|---|
| Color Development | 3 min 30 sec | 33 ± 0.15° C. | 88 | 327 |
| Blixing | 1 min 30 sec | 33 ± 3° C. | 35 | 120 |
| Washing (1) | 40 sec | 24 ± 34° C. | 17 | — |
| Washing (2) | 40 sec | 24 ± 34° C. | 17 | — |
| Washing (3) | 40 sec | 24 ± 34° C. | 17 | 250 |

In the washing step, a three bath counter-current system was employed, the replenisher for washing tank was supplied to the washing tank (3) from the lower portion thereof, the overflow water from the washing tank (3) was introduced into the lower portion of the tank (2), the overflow water from the washing tank (2) was introduced into the lower portion of the water tank (1) and overflow water from the tank (1) was discarded. In addition, the amount of the liquid carried by the light-sensitive material from the previous bath was 25 ml per square meter of the color paper.

The compositions of the tank liquids and the replenishers of each processing liquid were as follows.

| Color Developer | Tank Liquid | Replenisher |
|---|---|---|
| Water | 800 ml | 800 ml |
| Diethylenetriaminepentaacetic Acid | 3.0 g | 3.0 g |
| Benzyl Alcohol | 15 ml | 17 ml |
| Diethylene Glycol | 10 ml | 10 ml |
| Sodium Sulfite | 2.0 g | 2.5 g |
| Potassium Bromide | 0.5 g | — |
| Sodium Carbonate | 30 g | 35 g |
| N-Ethyl-N-(β-methanesulfonamidoethyl)-3-methyl-4-aminoaniline Sulfate | 5.0 g | 7.0 g |
| Hydroxylamine Sulfate | 4.0 g | 4.5 g |
| Fluorescent Whitening Agent | 1.0 g | 1.5 g |
| Water to make | 1 l | 1 l |
| pH | 10.10 | 10.50 |

| Blix Liquid | Tank Liquid | Replenisher |
|---|---|---|
| Water | 400 ml | 400 ml |
| Ammonium Thiosulfate (70% soln.) | 150 ml | 300 ml |
| Sodium Sulfite | 12 g | 25 g |
| Ethylenediaminetetraacetic Acid Iron(III) Ammonium | 55 g | 110 g |
| Ethylenediaminetetraacetic Acid Disodium Salt | 5 g | 10 g |
| Water to make | 1 l | 1 l |
| pH (at 25° C.) | 6.70 | 6.50 |

Washing Water

The tank liquid and replenisher had the same composition as follows.

| | |
|---|---|
| Benzotriazole | 1.0 g |
| Water to make | 1 l |

The processing amount is 180 meters of a roll paper of 8.25 cm in width per one day for 60 days.

When the composition of the liquid in the blixing tank after the processing was analyzed, the main components were as follows.

| | |
|---|---|
| Ethylenediaminetetraacetic Acid Iron(III) Ammonium | 65 g |
| Ammonium Thiosulfate (70% solution) | 210 ml |
| Sodium Sulfite | 4.0 g |
| pH | 7.10 |

Then, multilayer silver halide Color Photographic Materials A and B were prepared by forming First Layer (the lowermost layer) to Seventh Layer (the uppermost layer) shown below on a paper support having polyethylene coating on both surfaces thereof. In this case, Magenta Coupler (a) was used for Color Photographic Material A and Magenta Coupler (b) for Color Photographic Material B.

First Layer: Blue-Sensitive Emulsion Layer

| | |
|---|---|
| Silver chlorobromide emulsion (bromide content: 80 mol %) | 0.40 g/m$^2$ as silver |
| Yellow Coupler Y-1 | 0.60 g/m$^2$ |
| Yellow coupler solvent (dibutyl phthalate) | 1.00 g/m$^2$ |

-continued

| | |
|---|---|
| Color Mixing Preventing Agent F-3 | 0.10 g/m$^2$ |

Second Layer: Interlayer

| | |
|---|---|
| Gelatin | 1.50 g/m$^2$ |

Third Layer: Green-Sensitive Emulsion Layer

| | |
|---|---|
| Silver chlorobromide emulsion (bromide content: 70 mol %) | 0.44 g/m$^2$ as silver |
| Magenta Coupler (a) or (b) | 0.35 g/m$^2$ |
| Magenta coupler solvent (tri-n-octyl phosphate) | 0.44 g/m$^2$ |
| Color Mixing Preventing Agent F-1 | 0.050 g/m$^2$ |
| Color Mixing Preventing Agent F-2 | 0.100 g/m$^2$ |

Fourth Layer: Ultraviolet Absorptive Layer

| | |
|---|---|
| Gelatin | 2.00 g/m$^2$ |
| Ultraviolet Absorbent UV-1 | 0.015 g/m$^2$ |
| Ultraviolet Absorbent UV-2 | 0.045 g/m$^2$ |
| Ultraviolet Absorbent UV-3 | 0.090 g/m$^2$ |
| Solvent (dibutyl phthalate) | 0.060 g/m$^2$ |

Fifth Layer: Red-Sensitive Emulsion Layer

| | |
|---|---|
| Silver chlorobromide emulsion (bromide content: 50 mol %) | 0.300 g/m$^2$ as silver |
| Cyan Coupler C-1 | 0.200 g/m$^2$ |
| Cyan Coupler C-2 | 0.200 g/m$^2$ |
| Cyan coupler solvent (dibutyl phthalate) | 0.240 g/m$^2$ |
| Ultraviolet Absorbent UV-1 | 0.020 g/m$^2$ |
| Ultraviolet Absorbent UV-2 | 0.050 g/m$^2$ |
| Ultraviolet Absorbent UV-3 | 0.060 g/m$^2$ |

Sixth Layer: Ultraviolet Absorptive Layer

| | |
|---|---|
| Gelatin | 1.50 g/m$^2$ |
| Ultraviolet Absorbent UV-1 | 0.050 g/m$^2$ |
| Ultraviolet Absorbent UV-2 | 0.150 g/m$^2$ |
| Ultraviolet Absorbent UV-3 | 0.300 g/m$^2$ |
| Solvent (dibutyl phthalate) | 0.200 g/m$^2$ |

Seventh Layer: Protective Layer

| | |
|---|---|
| Gelatin | 1.50 g/m$^2$ |

In this case, the coating composition for First Layer described above was prepared as follows.

That is, 100 g of Yellow Coupler Y-1 was dissolved in a mixture of 166.7 ml of dibutyl phthalate (DEF) and 200 ml of ethyl acetate, the solution thus obtained was dispersed and emulsified in 800 g of an aqueous 10% gelatin solution containing 80 ml of an aqueous solution of 1% sodium dodecylbenzenesulfonate, and then the emulsified dispersion was mixed with 1,450 g of a blue-sensitive silver chlorobromide emulsion containing 66.8 g of silver (bromide content: 80 mol %) to provide the coating composition.

The coating compositions for other layers were also prepared in an analogous manner as above. In addition, for each layer was used 2,4-dichloro-6-hydroxy-s-triazine sodium salt as a hardener.

Also, spectral sensitizers for the above emulsion layers were as follows.

Blue-Sensitive Emulsion Layer:

3,3'-Di(γ-sulfopropyl)selenacyanine sodium salt ($2\times10^{-4}$ mol per mol of silver halide)

Green-Sensitive Emulsion Layer:

3,3'-Di(γ-sulfopropyl)-5,5'-diphenyl-9-ethyloxycarbocyanine sodium salt ($2.5\times10^{-4}$ mol per mol of silver halide)

Red-Sensitive Emulsion Layer:

3,3'-Di(γ-sulfopropyl)-9-methylthiadicarbocyanine sodium salt ($2.5\times10^{-4}$ mol per mol of silver halide)

Also, for the above emulsion layers, the following dyes were used as irradiation preventing dyes.

Green-Sensitive Emulsion Layer:

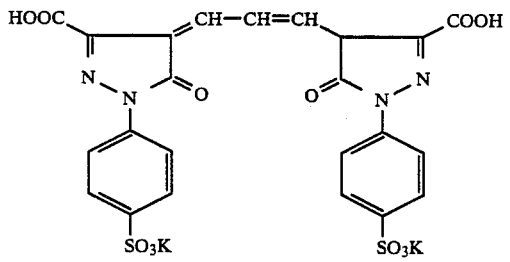

Red-Sensitive Emulsion Layer:

-continued

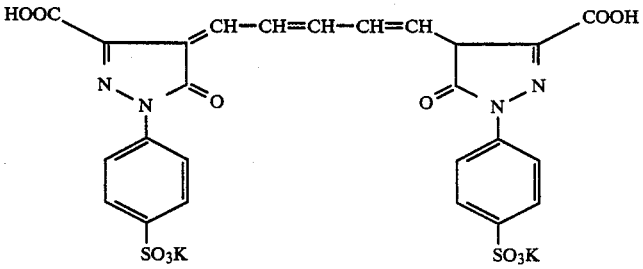

The compounds used for preparing the color photographic paper described above were as follows.

Ultraviolet Absorbent UV-1

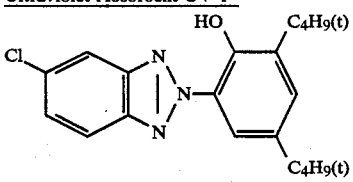

Ultraviolet Absorbent UV-2

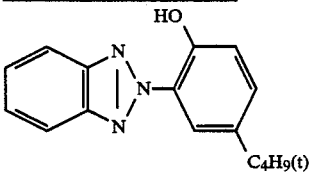

Ultraviolet Absorbent UV-3

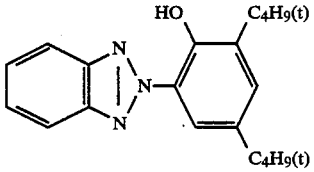

Color Mixing Preventing Agent F-1

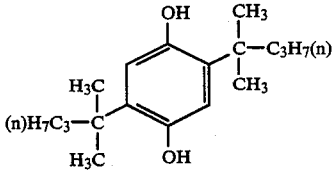

Color Mixing Preventing Agent F-2

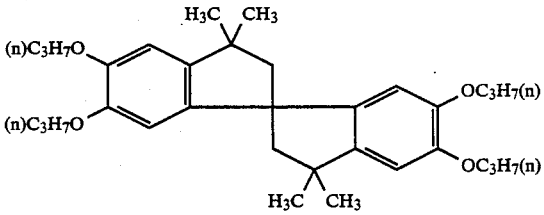

Color Mixing Preventing Agent F-3

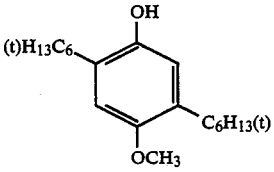

-continued

Cyan Coupler C-1

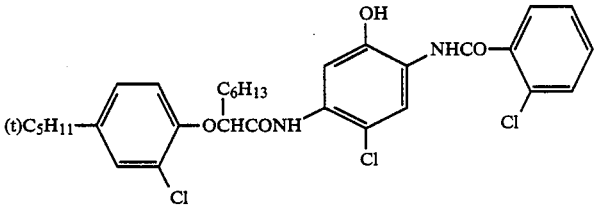

Cyan Coupler C-2

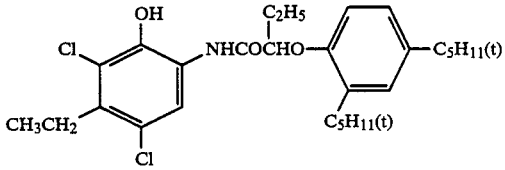

Yellow Coupler Y-1

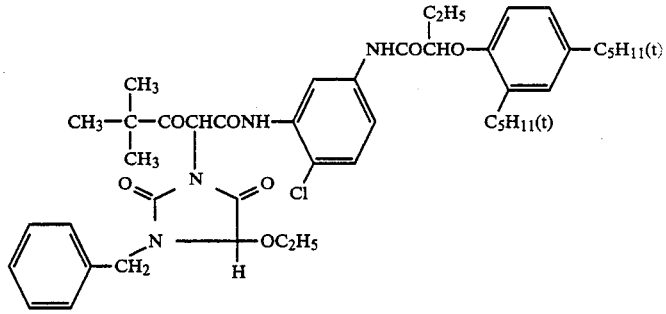

Magenta Coupler (a)

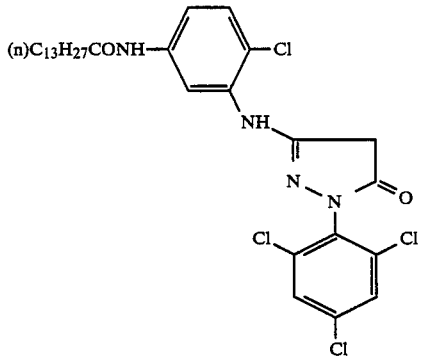

Magenta Coupler (b)

-continued

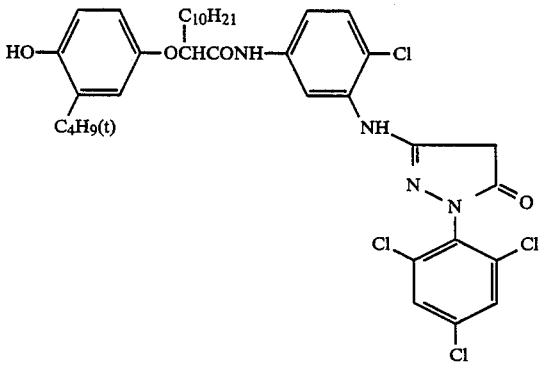

After imagewise exposing Color Photographic Materials A and B thus prepared, each sample was processed by the following processing step using the running liquids after the continuous process described above. Then, the yellow stain and magenta stain of each sample immediately after processing and after being allowed to stand for 2 months at 60° C. and 70% RH were measured by a Macbeth densitometer. Also, the remaining amount of silver of the processed samples was determined by X-ray fluorescence measurement.

| Processing Step | Time | Temperature (°C.) |
|---|---|---|
| Color Development | 3 min 30 sec | 33 |
| Blixing | Shown in Table 1 | 33 |
| Washing (1) | 40 sec | 30 |
| Washing (2) | 40 sec | 30 |
| Washing (3) | 40 sec | 30 |

For additional samples, the same experiment as above was performed except that sodium sulfite was added to the blixing liquid.

The results obtained are shown in Table 1.

As shown in Table 1 above, in a standard blixing time (Test No. 9) and a large amount water washing condition (Test No. 5) there were no problems in silver removal and stain formation, but when the blixing time was shorter than the time defined in the present invention (Test Nos. 1 and 2), the formation of yellow stain was increased and also silver removal was poor. Also, even if the shortened blixing time is within the defined time in the present invention, an increased formation of yellow stain is observed with the passage of time when the concentration of sodium sulfite was less (Test Nos. 3, 4, and 10) and also silver removal became poor when the concentration of sodium sulfite was too large (Test Nos. 8 and 12). As shown above, in a process with a shortened blixing time and reduced amount of a replenishing amount of washing water, the concentration of sulfite ion in the blix liquid closely relates to the formation of yellow stain and silver removal. In the present invention (Test Nos. 6, 7, 11 and 13), there were no problems with respect to the formation of yellow stain and silver removal.

EXAMPLE 2

By following the same procedure as in Example 1 except that the magenta coupler was changed and the addition amount of the silver chlorobromide emulsion in Fifth Layer was changed to 0.22 g/m$^2$, multilayer silver halide Color Photographic Materials C, D and E were prepared. The magenta couplers used in this example are shown in Table 2 below.

Each of the samples thus prepared was imagewise exposed and processed as in Example 1 using the running liquid while changing the blixing time and the concentration of sulfite ion. Thereafter, yellow and magenta stains and remaining silver amount of each sample immediately after processing and after allowing to stand the samples for 2 months at 60° C. and 70% RH. The results thus obtained are shown in Table 2 below.

TABLE 1

| | | | Processing Conditions | | | | Immediately after Processing | | After 2 months |
|---|---|---|---|---|---|---|---|---|---|
| Test No. | Sample No. | Magenta Coupler | Blixing Time (sec) | Blixing Liquid Sodium Sulfite (g/l) | Washing Conditions | Silver*1 Removal | Yellow Stain | Magenta Stain | at 60° C., 70% RH Yellow Stain |
| 1 | A | (a) | 10 | 4.0 | Running Liquid | x | 0.14 | 0.09 | 0.60 |
| 2 | A | (a) | 20 | 4.0 | " | x | 0.13 | 0.09 | 0.55 |
| 3 | A | (a) | 30 | 4.0 | " | O | 0.11 | 0.08 | 0.51 |
| 4 | A | (a) | 60 | 4.0 | " | O | 0.11 | 0.08 | 0.46 |
| 5 | A | (a) | 60 | 4.0 | Fresh Water*2 | O | 0.11 | 0.08 | 0.30 |
| 6 | A | (a) | 60 | 10.0 | Running Liquid | O | 0.11 | 0.08 | 0.31 |
| 7 | A | (a) | 60 | 20.0 | " | O | 0.11 | 0.08 | 0.30 |
| 8 | A | (a) | 60 | 40.0 | " | x | 0.11 | 0.08 | 0.30 |
| 9 | A | (a) | 90 | 4.0 | " | O | 0.11 | 0.08 | 0.30 |
| 10 | B | (b) | 60 | 6.0 | " | O | 0.11 | 0.09 | 0.48 |
| 11 | B | (b) | 60 | 20.0 | " | O | 0.11 | 0.09 | 0.30 |
| 12 | B | (b) | 60 | 40.0 | " | x | 0.11 | 0.09 | 0.30 |
| 13 | B | (b) | 60 | 15 g of $K_2SO_3$ further added | " | O | 0.11 | 0.09 | 0.30 |

Test Nos. 1–5, 8–10, and 12: Comparison; Test Nos. 6, 7, 11, 13: Invention.

(Notes)

*1The silver removal was evaluated as follows by the remaining silver amount:

x: Silver amount of more than 5 g/cm$^2$

Δ: Silver amount of 3 to 5 g/cm$^2$

O: Silver amount of less than 3 g/cm$^2$

*2In the running development process, the replenishing amount of washing water for washing bath (3) was increased to 5 liters/m$^2$, which was substantially the same condition as the case of washing with fresh water.

TABLE 2

| Test No. | Sample No. | Magenta Coupler | Processing Conditions: Blixing Time (sec) | Blixing Liquid Sodium Sulfite (g/l) | Washing Conditions | Silver*[1] Removal | Immediately after Processing: Yellow Stain | Magenta Stain | After 2 Months at 60° C., 70% RH: Yellow Stain | Magenta Stain |
|---|---|---|---|---|---|---|---|---|---|---|
| 14 | C | (M-26) | 90 | 4.0 | Fresh Water | O | 0.09 | 0.10 | 0.18 | 0.13 |
| 15 | C | " | 90 | 4.0 | Running Liquid | O | 0.09 | 0.10 | 0.19 | 0.14 |
| 16 | C | " | 60 | 4.0 | " | O | 0.11 | 0.12 | 0.23 | 0.30 |
| 17 | C | " | 60 | 10.0 | " | O | 0.09 | 0.10 | 0.19 | 0.14 |
| 18 | C | " | 60 | 20.0 | " | O | 0.09 | 0.10 | 0.18 | 0.13 |
| 19 | D | (M-41) | 90 | 4.0 | Fresh Water | O | 0.09 | 0.08 | 0.17 | 0.10 |
| 20 | D | " | 60 | 4.0 | Running Liquid | O | 0.09 | 0.10 | 0.24 | 0.25 |
| 21 | D | " | 60 | 15.0 | " | O | 0.09 | 0.08 | 0.17 | 0.10 |
| 22 | D | " | 20 | 15.0 | " | Δ | 0.10 | 0.11 | 0.21 | 0.22 |
| 23 | D | " | 60 | 50.0 | " | x | 0.09 | 0.08 | 0.17 | 0.10 |
| 24 | E | (M-61) | 90 | 4.0 | Fresh Water | O | 0.09 | 0.09 | 0.15 | 0.15 |
| 25 | E | " | 60 | 4.0 | Running Liquid | O | 0.09 | 0.10 | 0.20 | 0.33 |
| 26 | E | " | 60 | 15.0 | " | O | 0.09 | 0.09 | 0.15 | 0.15 |
| 27 | E | " | 40 | 15.0 | " | O | 0.09 | 0.09 | 0.16 | 0.16 |
| 28 | E | " | 40 | 15 g of $K_2SO_3$ further added | " | O | 0.09 | 0.09 | 0.15 | 0.15 |
| 29 | E | " | 60 | 20 g of $(NH_4)_2SO_3$ further added | " | O | 0.09 | 0.09 | 0.15 | 0.15 |
| 30 | A | (a) | 90 | 4.0 | " | O | 0.11 | 0.08 | 0.30 | 0.13 |

*[1]Silver removal: Same as in Table 1.
Test Nos. 14 to 16, 19, 20, 22 to 25 and 30: Comparison Test Nos. 17, 18, 21, and 26 to 29: Invention As shown in Table 2, in the present invention (Test Nos. 17, 18, 21 and 26 to 29), the magenta stain density after allowing to stand for 2 months was almost the same level as that of the standard samples (Test Nos. 14, 19 and 24) in spite of that the blixing time was shorter than those of the standard samples.

EXAMPLE 3

In Example 1, the following compounds were added to the washing bath (3) only in the running washing liquids obtained in the amounts shown below per liter of the washing liquid in the bath.

| | |
|---|---|
| 1-Hydroxyethylidene-1,1-diphosphonic Acid (60% solution) | 1.5 g |
| Ammonium Alum | 0.5 g |

The pH was adjusted to 7.0 with aqueous ammonia.

The same processing as in Example 2 was performed using the running liquids as in Example 1, except that the composition of the washing bath (3) was changed as above, and then the yellow stain and magenta stain of each sample immediately after processing and after allowing to stand for 2 months at 60° C. and 70% RH. The results obtained were almost the same as in Example 2.

As described above, by the process of the present invention for silver halide color photographic materials, the blixing time is shortened and the replenishing amount of washing water for washing processing is greatly reduced without reducing the storability of color images. In particular, in a color photographic material using a magenta coupler having high coloring property, magenta stain is liable to form with the passage of time but even in the case of such a color photographic material, the formation of magenta stain is prevented by employing the process of the present invention.

While the invention has been described in detail and with reference to specific embodiments thereof, it will be apparent to one skilled in the art that various changes and modifications can be made therein without departing from the spirit and scope thereof.

What is claimed is:

1. A process for processing a silver halide color photographic material having a coated amount of silver of 1.0 g/m$^2$ or less, after imagewise exposing said silver halide color photographic material, comprising color developing, blixing, and then washing, wherein the processing time for said blixing is from 30 seconds to about 70 seconds, the blixing liquid for said blixing has a pH of from 4 to 8 and contains from about 0.08 to about 0.30 mol/liter of sulfite ion, and the replenishing amount of washing water for said washing is from about 3 times to about 50 times the amount of processing liquid carried from the previous bath per unit area of said color photographic material.

2. A process for processing a silver halide color photographic material as in claim 1, wherein the processing time for said blixing is from 40 seconds to 60 seconds.

3. A process for processing a silver halide color photographic material as in claim 1, wherein the blixing liquid for said blixing contains from 0.10 to 0.20 mol/liter of sulfite ion.

4. A process for processing a silver halide color photographic material as in claim 1, wherein said blixing liquid contains a bleaching agent comprising an iron(III) complex salt of at least one of ethylenediaminetetraacetic acid, diethylenetriaminepentaacetic acid, cyclohexanediaminetetraacetic acid, 1,2-diaminopropanetetraacetic acid, and methyliminodiacetic acid.

5. A process for processing a silver halide color photographic material as in claim 4, wherein said bleaching agent is present in an amount of from 0.15 to 0.5 mol per liter of said blixing liquid.

6. A process for processing a silver halide color photographic material as in claim 5, wherein said bleaching agent is present in an amount of from 0.2 to 0.4 mol per liter of said blixing liquid.

7. A process for processing a silver halide color photographic material as in claim 1, wherein said fixing agent is present in an amount of from 0.3 to 2 mol per liter of said blixing liquid.

8. A process for processing a silver halide color photographic material as in claim 7, wherein said fixing agent is present in an amount of from 0.5 to 1.0 mol per liter of said blixing liquid.

9. A process for processing a silver halide color photographic material as in claim 1, wherein the pH of said blixing liquid is in the range of from 4 to 8.

10. A process for processing a silver halide color photographic material as in claim 1, wherein the replenishing amount of washing water for said washing is from about 5 to about 15 times the amount cf processing liquid carried from the previous bath per unit area of said color photographic material.

11. A process for processing a silver halide color photographic material as in claim 1, wherein the washing time for said washing is from 30 seconds to 5 minutes.

12. A process for processing a silver halide color photographic material as in claim 11, wherein the washing time for said washing is from 40 seconds to 4 minutes.

13. A process for processing a silver halide color photographic material as in claim 1, wherein said silver halide color photographic material comprises a silver halide in a coated amount of 2.0 g/m$^2$ or less calculated as silver.

14. A process for processing a silver halide color photographic material as in claim 1, wherein the processing time for the color development step is from about 50 seconds to about 4 minutes.

15. A process for processing a silver halide color photographic material as in claim 1, wherein said material contains a magenta coupler represented by at least one of formulae (I) and (II):

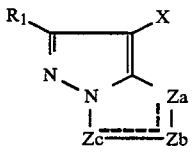

(I)

wherein $R_1$ represents a hydrogen atom or a monovalent organic substituent; X represents a hydrogen atom or a group capable of releasing upon occurrence of a coupling reaction with the oxidation product of an aromatic primary amine developing agent; and Za, Zb and Zc each represents a methine group, a substituted methine group, =N— or —NH—; at least one of said Za, Zb and Zc represents =N— or —NH—; one of the Za13 Zb bond and the Zb—Zc bond is a double bond and the other is a single bond; and when the Zb13 Zc bond is a carbon-carbon double bond, said Zb—Zc bond is a double bond or a part of an aromatic ring; or said magenta coupler represented by formula (I) forms a dimer or oligomer at said $R_1$ or X; or when said Za, Zb or Zc is a substituted methine group, said magenta coupler forms a dimer or oligomer at said substituted methine group; and

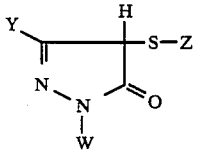

(II)

wherein W represents an aryl group; Z represents an alkyl group, an aryl group, or a heterocyclic group; and Y represents an acylamino group, a ureido group, or an anilino group.

16. A process for processing a silver halide color photographic material as in claim 15, wherein said magenta coupler is a coupler represented by formula (I) selected from the group consisting of 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles, and 1H-pyrazolo[1,5-a]benzimidazoles.

17. A process for processing a silver halide color photographic material as in claim 15, wherein said magenta coupler is a coupler represented by formula (II) which is represented by formula (IX) or (X):

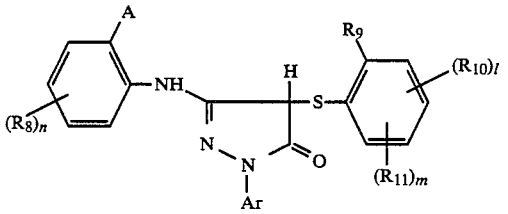

(IX)

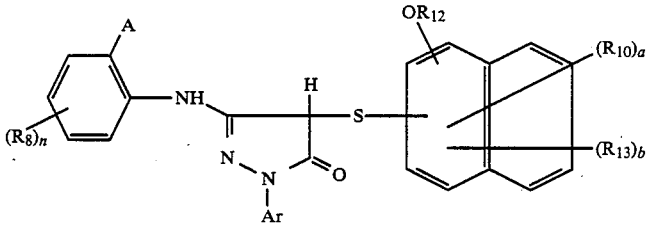

(X)

wherein

Ar represents a phenyl group substituted by at least one halogen atom, alkyl group, alkoxy group, alkoxycarbonyl group, or cyano group;

A represents a halogen atom or an alkoxy group;

$R_8$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, a ureido group, an acyl group, a nitro group, or a carboxy group;

$R_9$ represents a halogen atom, a hydroxy group, an amino group, an alkyl group, an alkoxy group, an aryloxy group, or an aryl group;

$R_{10}$ represents a hydrogen atom, an amino group, an acylamino group, a ureic group, an alkoxycarbonylamino group, an imido group, a sulfonamido group, a sulfamoylamino group, a nitro group, an alkoxycarbonyl group, a carbamoyl group, an acyl group, a cyano group or an alkylthio group;

$R_{11}$ represents a hydrogen atom, a halogen atom, a hydroxy group, an alkyl group, an alkoxy group or an aryl group;

at least one of said $R_9$ and $R_{10}$ represents an alkoxy group;

m represents an integer of 1 to 3;

n represents an integer of 1 to 4;

l represents an integer of 1 to 3;

$R_{12}$ represents an alkyl group or an aryl group; and $R_{13}$ represents a hydrogen atom, a halogen atom, an alkyl group, an alkoxy group, an aryloxy group, or an aryl group, and a and b each represents an integer of 1 to 5.

18. A process for processing a silver halide color photographic material as in claim 1, wherein the washing time is from 30 to 20 seconds.

* * * * *